US007028354B2

(12) United States Patent
Nygren et al.

(10) Patent No.: US 7,028,354 B2
(45) **Date of Patent: *Apr. 18, 2006**

(54) BED RAIL AND CLAMP

(75) Inventors: Kurt Nygren, Harvard, MA (US); Jorge Tomas, Wrentham, MA (US); Robert D. Monahan, Norwell, MA (US); Steve Lepke, Wakefield, MA (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/003,641

(22) Filed: Dec. 3, 2004

(65) Prior Publication Data

US 2005/0229309 A1 Oct. 20, 2005

Related U.S. Application Data

(63) Continuation of application No. 10/735,356, filed on Dec. 12, 2003, and a continuation of application No. 10/734,346, filed on Dec. 12, 2003, now Pat. No. 6,886,196.

(60) Provisional application No. 60/433,113, filed on Dec. 13, 2002.

(51) Int. Cl.
*A47C 21/08* (2006.01)

(52) U.S. Cl. ..... 5/430; 5/426; 24/72.5

(58) Field of Classification Search ..... 5/430, 5/426, 429, 428, 425, 427; 24/72.5
See application file for complete search history.

(56) References Cited

U.S. PATENT DOCUMENTS

| | | | | |
|---|---|---|---|---|
| 1,760,346 | A * | 5/1930 | Correa | 24/72.5 |
| 2,649,594 | A | 8/1953 | Herz et al. | 5/425 |
| 2,722,693 | A | 11/1955 | Wolf | 5/426 |
| 2,751,608 | A | 6/1956 | Lucas | 5/426 |
| 5,640,726 | A | 6/1997 | Fichner-Rathus | 5/426 |
| 5,671,490 | A | 9/1997 | Wu | |
| 6,134,731 | A | 10/2000 | Thom et al. | 5/662 |
| 6,289,539 | B1 | 9/2001 | Alpern | 5/662 |
| 6,453,490 | B1 | 9/2002 | Cardinale | 5/426 |
| 6,725,476 | B1 | 4/2004 | Macari | 5/426 |
| 2004/0040089 | A1 | 3/2004 | Flannery et al. | 5/425 |
| 2004/0049849 | A1 | 3/2004 | Macari | 5/426 |
| 2004/0154100 | A1 | 8/2004 | Macari | 5/426 |
| 2004/0168251 | A1* | 9/2004 | Waldman et al. | 5/426 |
| 2004/0187209 | A1 | 9/2004 | Flannery et al. | 5/425 |

FOREIGN PATENT DOCUMENTS

| | | |
|---|---|---|
| GB | 2070921 A | 9/1981 |
| GB | 2225716 A | 6/1990 |

* cited by examiner

*Primary Examiner*—Alexander Grosz
(74) *Attorney, Agent, or Firm*—Barnes & Thornburg LLP

(57) ABSTRACT

A bed rail is disclosed for use with a bed. The bed rail includes a support portion joined to a rail portion. The support portion being adjustable to grip a member such as a mattress member. A fold controller controls foldable movement of the bed rail and adjustment to clamp the bedrail to the bed.

14 Claims, 14 Drawing Sheets

BED RAIL AND CLAMP

CROSS-REFERENCE

This application claims priority under 35 U.S.C. §119(e) to U.S. Provisional Application No. 60/433,113, filed Dec. 13, 2002, which is hereby incorporated by reference herein. This application is a continuation and claims benefit of U.S. patent application Ser. No. 10/734,346 filed Dec. 12, 2003, now U.S. Pat. No. 6,886,196, the subject matter of which is hereby incorporated by reference. This application is a continuation and claims benefit of U.S. patent application Ser. No. 10/735,356 filed Dec. 12, 2003, the subject matter of which is hereby incorporated by reference.

Cross-reference is made to co-pending U.S. patent application Ser. No. 10/734,392 entitled "Bed Rail With Clamping Force Indicator", filed Dec. 12, 2003, now U.S. Pat. No. 6,934,984, which is assigned to the same assignee as the present application, and which is hereby incorporated by reference herein.

BACKGROUND

The present disclosure relates to bed rails. Bed rails are used with beds to help retain individuals in bed.

SUMMARY

According to the present disclosure, a bed rail comprises a side rail and a clamp. The clamp cooperates with the side rail to clamp a mattress to mount the side rail alongside the mattress and to unclamp the mattress. The clamp is configured for foldable movement to move the side rail between a raised position and a fold-down position. The clamp includes a fold controller to control movement between the raised and fold-down positions.

The fold controller includes a leg and a leg receiver. The leg is arranged to be received in the leg receiver to position the side rail in the raised position and to be removed from the leg receiver to position the side rail in the fold-down position. An articulated joint is coupled to the leg and the leg receiver to facilitate movement of the leg relative to the leg receiver between the raised and fold-down positions.

The fold controller includes a lock and a lock release. The lock is used to lock the leg in the leg receiver to position the side rail in the raised position. The lock release is used to release the lock to allow removal of the leg from the leg receiver to position the side rail in the fold-down position.

Additional features of the apparatus will become apparent to those skilled in the art upon consideration of the following detailed description exemplifying the best mode of the disclosure as presently perceived.

BRIEF DESCRIPTION OF THE DRAWINGS

The detailed description particularly refers to the accompanying figures in which.

DETAILED DESCRIPTION

Figure 1:
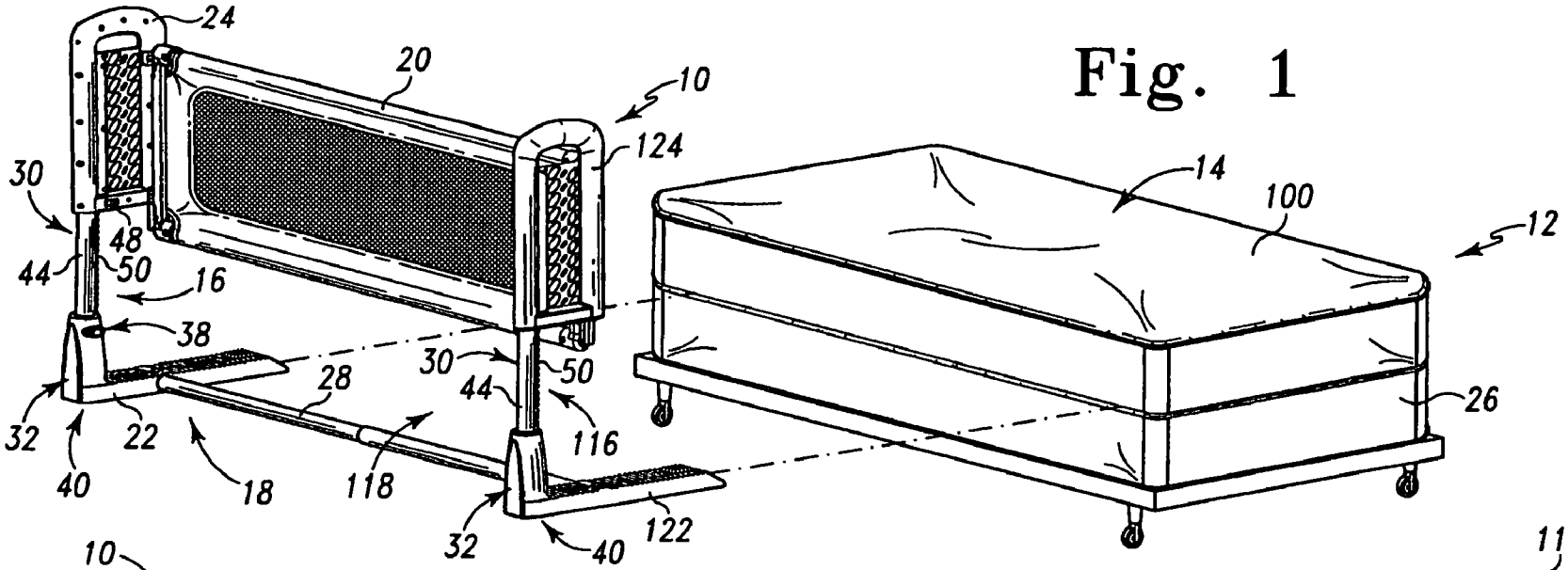
FIG. 1 is a perspective view showing a bed and a bed rail including a side rail extending between left and right clamps arranged to cooperate with the side rail to clamp a mattress of the bed to position the side rail alongside the mattress.
Figure 4:
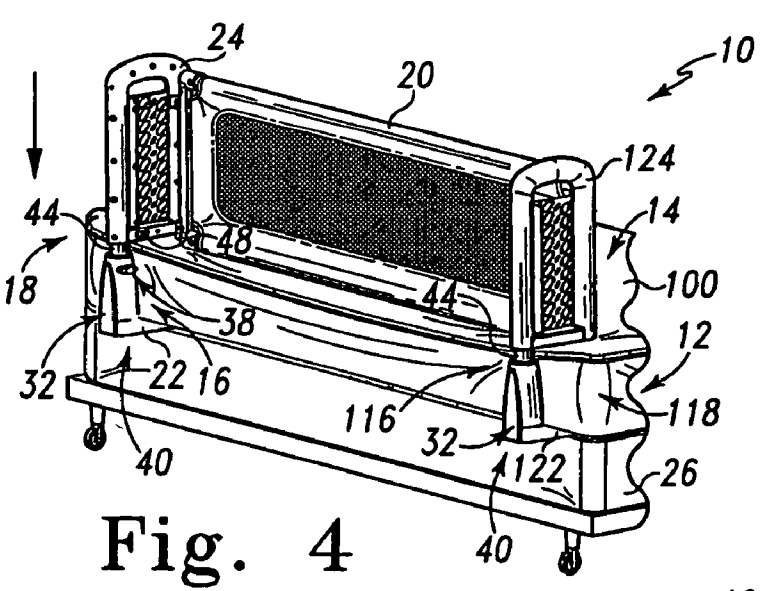
FIG. 4 is a perspective view showing the bed rail in the clamped position in which the bed rail clamps the mattress to mount the side rail alongside the mattress.
Figure 3:
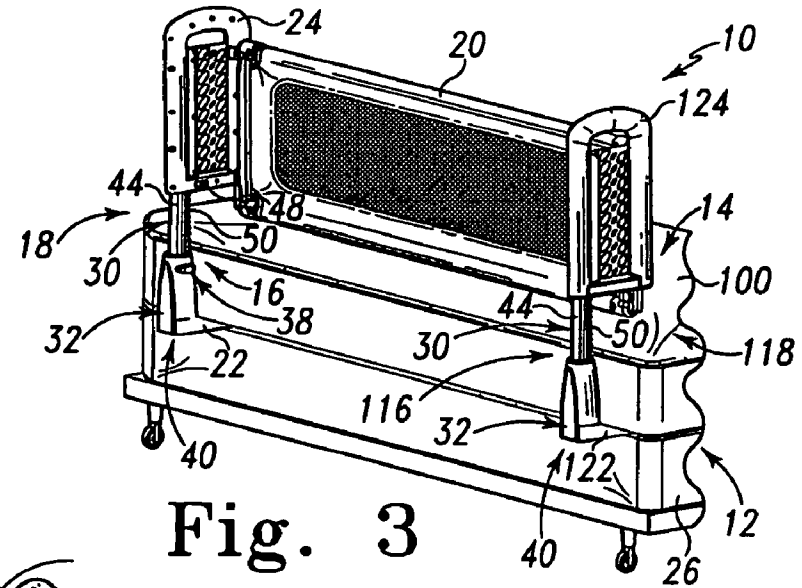
FIG. 3 is a perspective view showing the bed rail in a raised position in which the bed rail is ready to be moved to a clamped position shown, for example, in FIG. 4 or to a fold-down position shown, for example, in FIG. 6.
Figure 5:
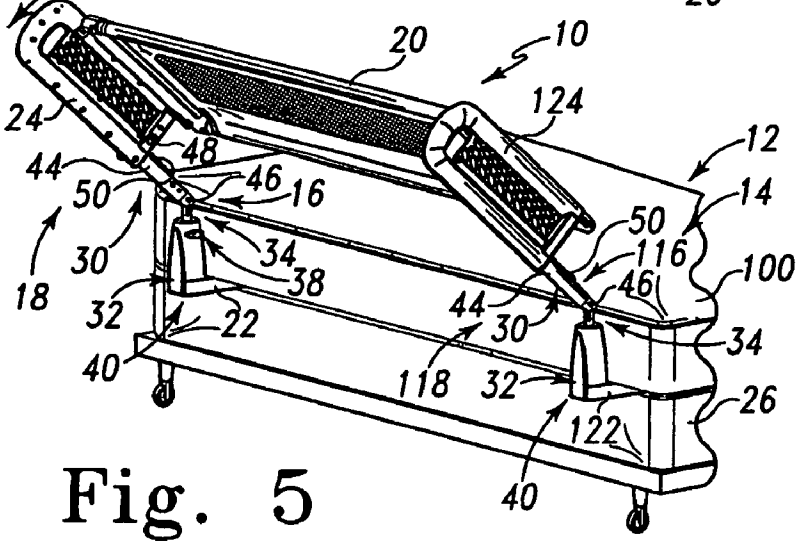
FIG. 5 is a perspective view showing foldable movement of the bed rail toward the fold-down position.
Figures 20, 21:
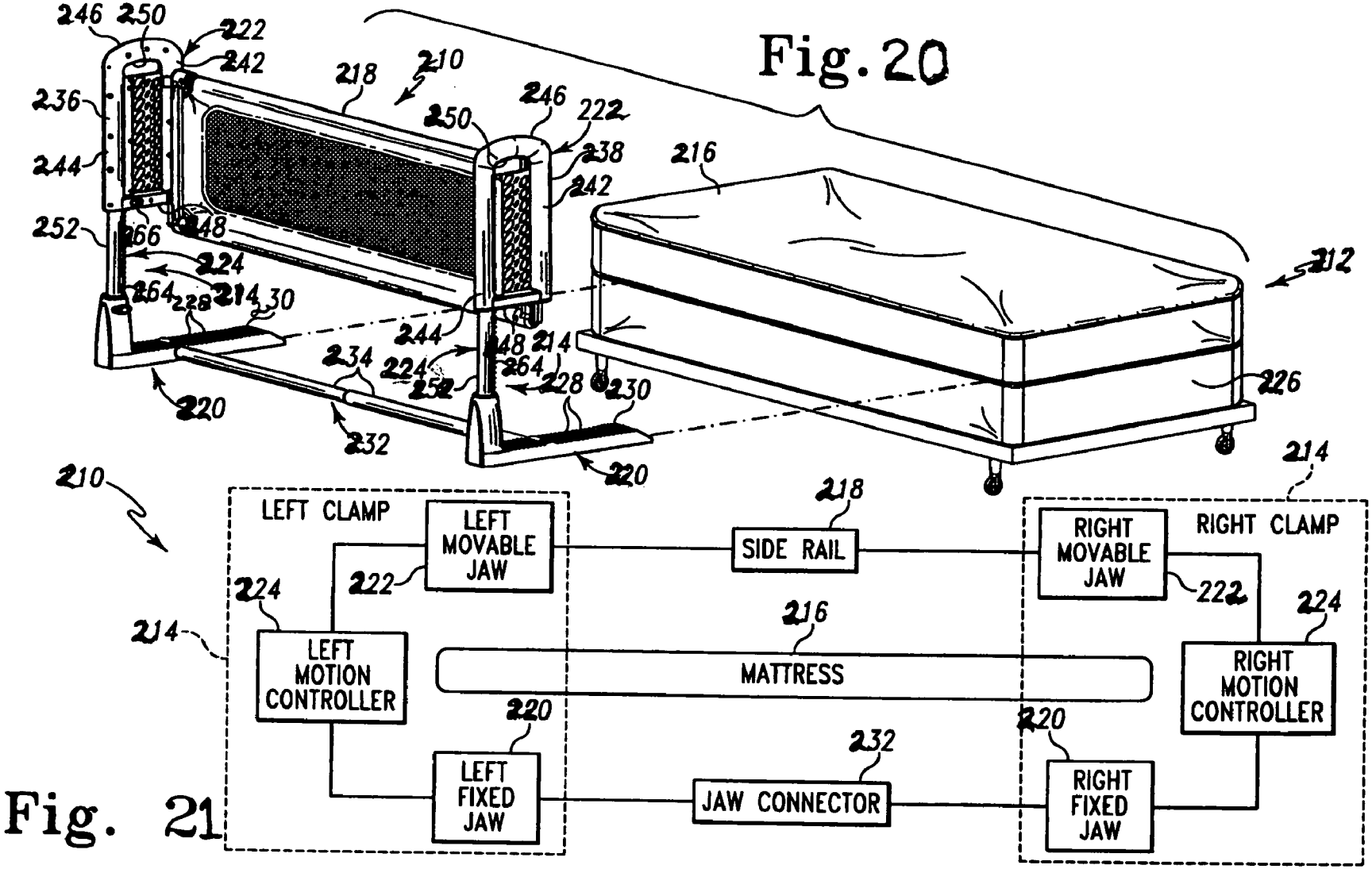
FIG. 20 is a perspective view of a second embodiment showing a bed and a bed rail including a side rail positioned between left and right clamps configured to clamp a mattress of the bed to position the side rail alongside the mattress.
FIG. 21 is a diagrammatic view showing components of the bed rail including the left and right clamps and showing each clamp including a fixed jaw configured to be positioned under the mattress, a movable jaw configured to be positioned over the mattress and to move relative to the fixed jaw to clamp the mattress between the fixed jaw and the movable jaw, and a motion controller to control movement of the movable jaw relative to the fixed jaw.

A bed rail 10 is configured to be mounted to a bed 12, as suggested, for example, in FIGS. 1 and 20. Bed rail 10 is mounted initially to bed 12 in a raised position in which bed rail 10 does not clamp a mattress 14 included in bed 12, as shown, for example, in FIGS. 3 and 8. From that position, bed rail 10 can be moved to either a clamped position shown, for example, in FIG. 4 or an out-of-the-way, fold-down position shown, for example, in FIGS. 5, 6, 12, and 15. In the raised position, bed rail 10 clamps mattress 14 so that bed rail 10 can be used to inhibit unintended movement of a person (not shown) off bed 12. The fold-down position is useful to allow uninhibited movement of a person off bed 12. Left and right fold controllers 16, 116 are included in bed rail 10 to control foldable movement of bed rail 10 between the raised and fold-down positions.

Figure 2:
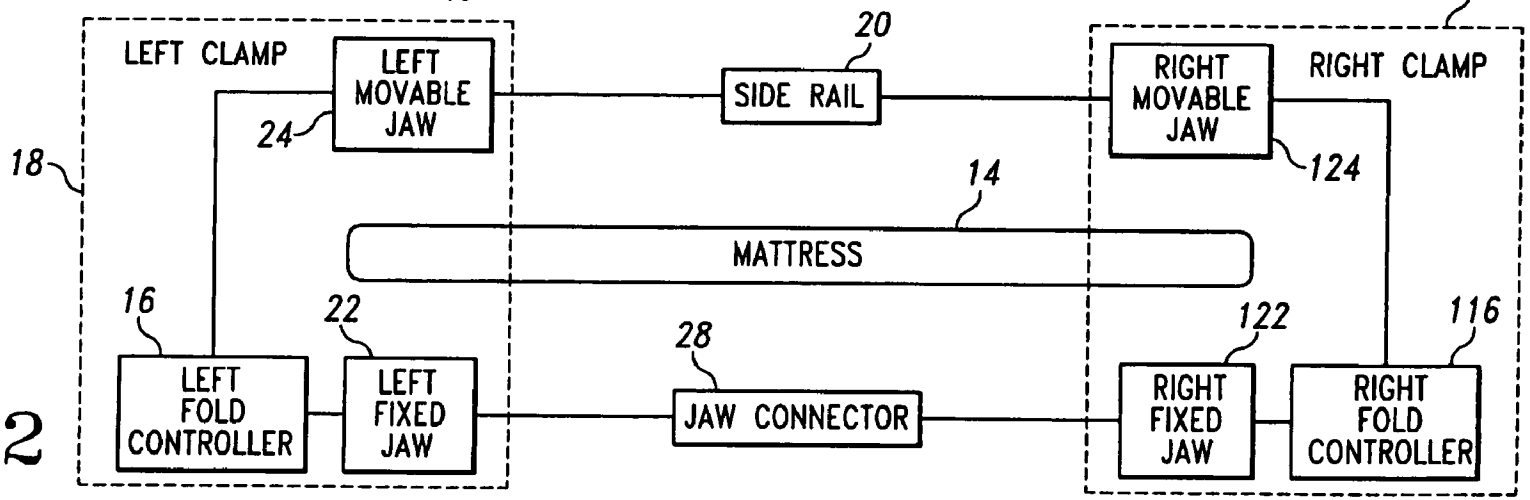
FIG. 2 is a diagrammatic view showing each clamp including a fold controller coupled to a fixed jaw and a movable jaw and arranged to control foldable movement of the bed rail.

Bed rail 10 includes left and right clamps 18, 118 and a side rail 20 coupled thereto, as shown, for example, in FIG. 1 and diagrammatically in FIG. 2. As seen in the drawings (e.g., FIG. 1) side rail 20 comprises a netting or net-like member joined to a frame and spanning a hollow region surrounded by the frame. Clamps 18, 118 and side rail 20 cooperate to clamp mattress 14 to mount side rail 20 alongside mattress 14.

Left clamp 18 includes a left fixed jaw (or base) 22, a left movable jaw 24, and left fold controller 16, as shown, for example, in FIG. 2. Similarly, right clamp 118 includes a right fixed jaw (or base) 122, a right movable jaw 124, and a right fold controller 116, as shown, for example, in FIG. 2. Fixed jaws 22, 122 and movable jaws 24, 124 comprise a support portion adjustable to grip mattress 14. As seen in, for example, FIG. 1 each of lower jaws 22 and 122 have a generally horizontally extending arm or base member and a generally vertically extending hollow arm comprising inner sleeve 54 portion (e.g., see FIGS. 7 and 9–11). Each of upper jaws 24 and 124 have generally horizontal and vertical arm portions or arms.

Fixed jaws 22, 122 are adapted to be positioned under mattress 14 in a fixed position between mattress 14 and an underlying box spring unit 26, as shown, for example, in FIGS. 3–6. A jaw connector 28 coupled to left and right fixed jaws 22, 122 is used for stabilization of bed rail 10.

Figure 8:
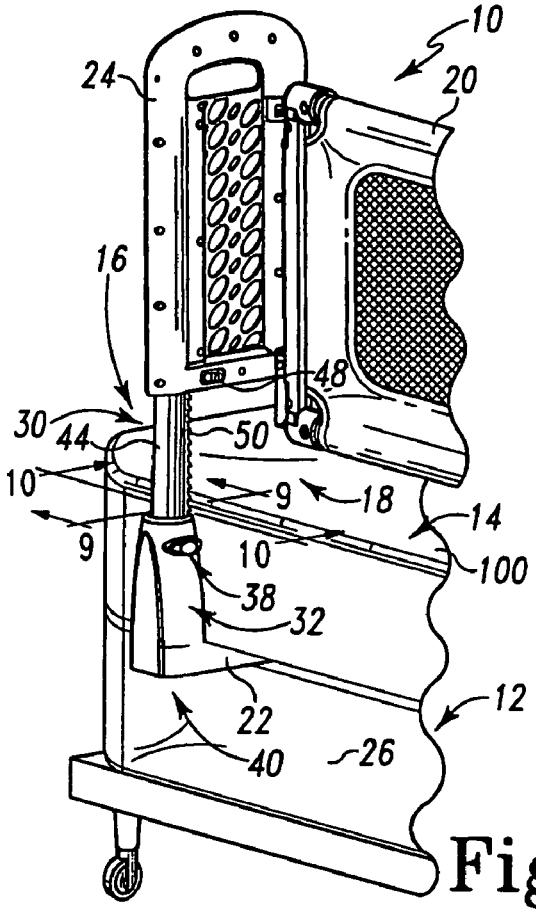
FIG. 8 is a perspective view, with portions broken away, showing the left clamp and a left end portion of the side rail in the raised position.
Figure 12:
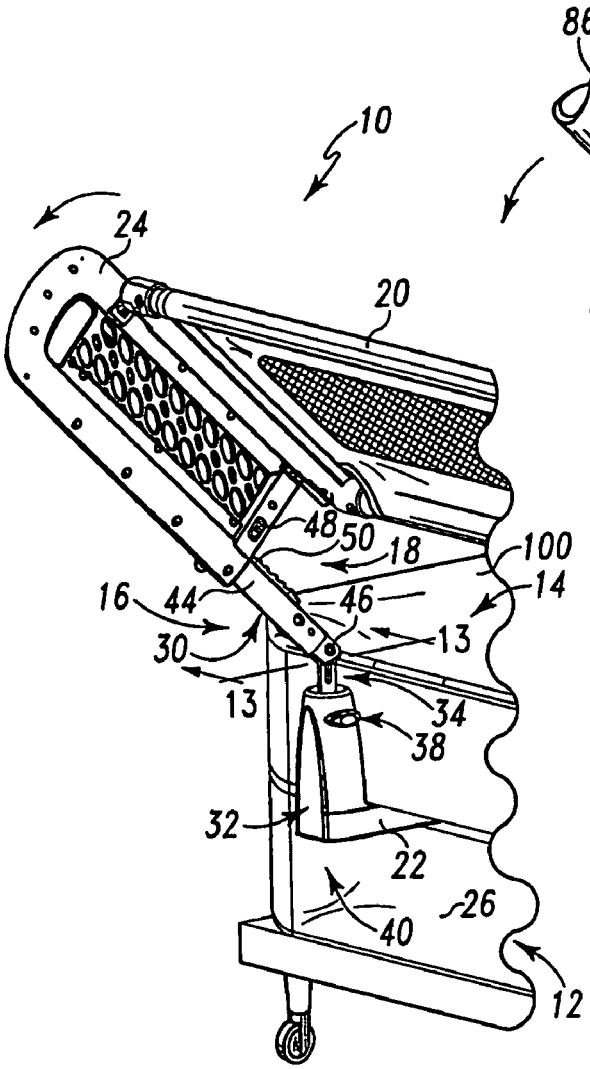
FIG. 12 is a perspective view, with portions broken away, showing foldable movement of the left clamp and the left end portion of the side rail.

As seen in, for example, FIGS. 1, 8 and 12 movable jaws 24, 124 are joined or coupled to side rail 20 and are arranged to move relative to fixed jaws 22, 122 to clamp and unclamp mattress 14. As seen in, for example, FIGS. 8 and 12 jaw 24 has two generally vertical and two generally horizontal arms with side rail 20 joined to a generally vertical arm. Movable jaws 24, 124 are arranged to move toward fixed jaws 22, 122 to move side rail 20 toward mattress 14 to clamp mattress 14 between side rail 20 and fixed jaws 22, 122 to mount side rail 20 alongside mattress 14, as shown, for example, in FIG. 4. Movable jaws 24, 124 are arranged to move away from fixed jaws 22, 122 to move side rail 20 away from mattress to unclamp mattress 14. Further details of the clamping and unclamping operation of bed rail 10 is discussed in U.S. patent application Ser. No. 10/735,356 entitled "Bed Rail" filed Dec. 12, 2003, and U.S. patent application Ser. No. 10/734,392 entitled "Bed Rail With Clamping Force Indicator" filed Dec. 12, 2003, now U.S. Pat. No. 6,934,984.

Left and right clamps 18, 118 are configured for foldable movement to move side rail 20 between the raised and fold-down positions. In the raised position, side rail 20 is positioned higher than fixed jaws (or bases) 22, 122 so that side rail 20 is positioned higher than a top surface 100 of mattress 14. In the fold-down position, side rail 20 is positioned higher than fixed jaws (or bases) 22, 122 so that side rail 20 is positioned higher than top surface 100 of mattress.

Left and right fold controllers 16, 116 are arranged to control such foldable movement of left and right clamps 18, 118. It is within the scope of this disclosure for fold controllers 16, 116 to control foldable movement of clamps 18, 118 between the clamped position and the fold-down position. As such, the clamped position may also be considered to be a "raised" position.

Left and right clamps 18, 118 are similar to one another in structure and function. Thus, further description herein of left clamp 18 and its components applies also to right clamp 118 and its components.

Figure 7:
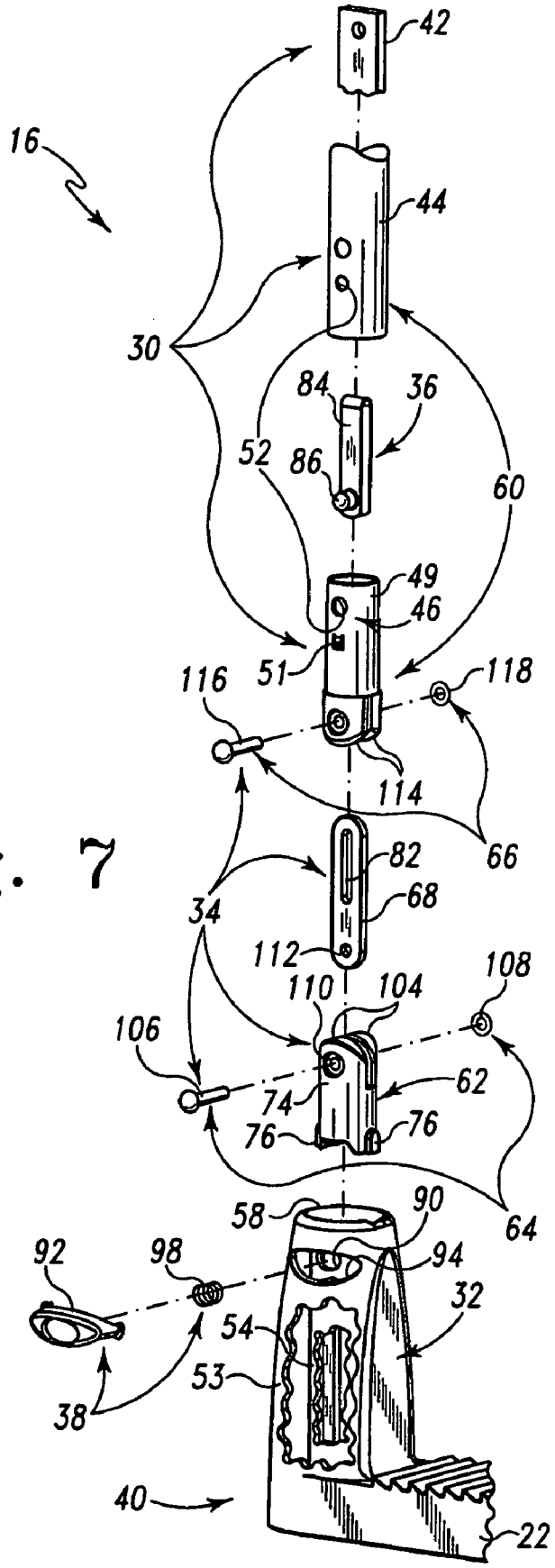
FIG. 7 is an exploded perspective view of components of the fold controller of the left clamp.

Fold controller 16 includes an elongated member or leg 30, a leg receiver 32, an articulated joint (or articulated "ankle" joint) 34, a releasable lock 36, and a lock release or push button 38, as shown, for example, in FIG. 7. Elongated member or leg 30 is coupled to movable jaw 24 for movement of side rail 20 coupled thereto between the raised and fold-down positions. Leg 30 is arranged to be received in leg receiver 32 to position side rail 20 in the raised position and is arranged to be removed from leg receiver 32 to position side rail 20 in the fold-down position. Leg receiver 32 is configured, for example, as a socket and cooperates with fixed jaw 22 to provide one of two feet 40 of bed rail 10. Articulated joint 34 is arranged to allow leg 30, and thus side rail 20, to move relative to leg receiver 32 between the raised and fold-down positions. Lock 36 is used to lock leg 30 in leg receiver 32 when leg 30 assumes the raised position. Lock release 38 is used to release lock 36 to allow removal of leg 30 from leg receiver 32 for movement to the fold-down position.

Leg 30 includes telescoping inner and outer tubes 42, 44 and an attachment 46 to outer tube 42, as shown, for example, in FIG. 7. Inner tube 42 is coupled to movable jaw 24 and is arranged to move into and out of outer tube 44 upon movement of movable jaw 24 along outer tube 44 during clamping and unclamping of mattress 14. A spring-biased movable button 48 coupled to movable jaw 24 is arranged to engage a ratchet 50 coupled to outer tube 44 to control movement of movable jaw 24 along outer tube 44. Attachment 46 is coupled to outer tube 42 upon insertion of an attachment body 49 included in attachment 46 into outer tube 42 and engagement between an attachment lug 51 coupled to body 49 and a lug-receiving opening 52 formed in outer tube 42, as shown, for example, in FIG. 9.

Figure 9:
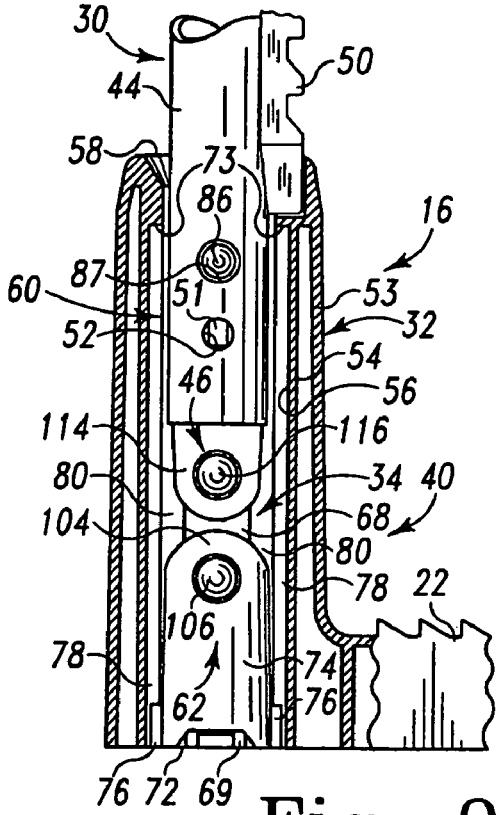
FIG. 9 is a sectional view taken along lines 9—9 of FIG. 8 showing the left fold controller including a leg receiver configured as a socket, a leg extending into the socket, and an articulated joint including a slidable anchor positioned in the leg receiver below the leg and a link coupled to the anchor by a first pivot and to the leg by a second pivot.

Leg receiver 32 includes an outer sleeve 53 and an inner sleeve 54, as shown, for example, in FIG. 9. Outer sleeve 53 is coupled to fixed jaw 22 and surrounds inner sleeve 54. Outer and inner sleeves 53, 54 are coupled to one another at top portions thereof. Inner sleeve 54 is formed to include a channel 56 and an upper end opening 58 through which a lower leg end portion 60 of leg 30 passes as it moves into and out of channel 56. Outer tube 44 and attachment 46 cooperate to provide lower leg end portion 60.

Articulated joint 34 is coupled to leg 30 and leg receiver 32 for movement of leg 30 relative to leg receiver 32 between the raised and fold-down positions. Joint 34 includes an anchor 62, first and second pivots 64, 66, and a link 68 coupled to anchor 62 by first pivot 64 and to attachment 46 by second pivot 66.

Figure 10:
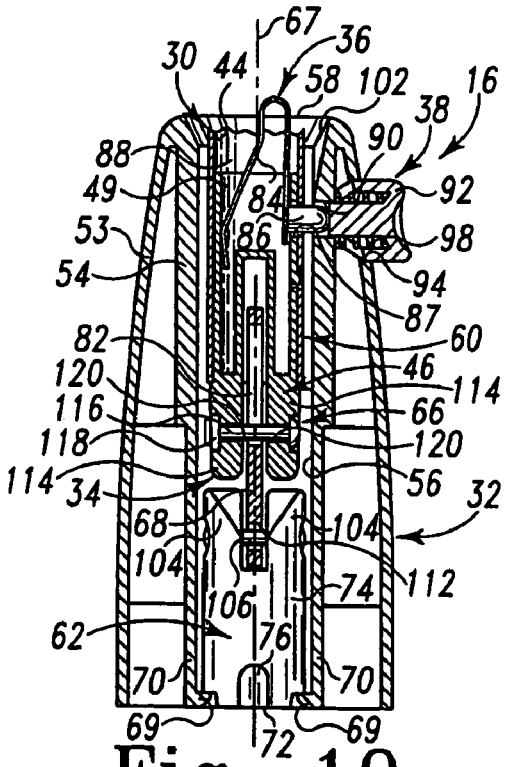
FIG. 10 is a sectional view taken along lines 10—10 of FIG. 8 showing the left fold controller including a lock positioned in a locked position to lock the leg in the leg receiver.
Figure 11:
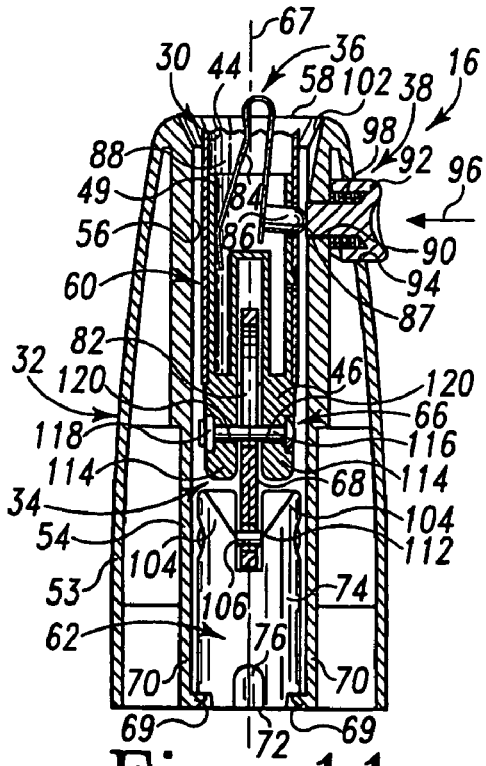
FIG. 11 is a sectional view similar to FIG. 10 showing actuation of a lock release to move the lock to an unlocked position to allow removal of the leg from the leg receiver and movement of the bed rail to the fold-down position.

Anchor 62 includes an anchor body 74 and a pair of anchor ears 104 coupled to and extending upwardly from anchor body 74, as shown, for example, in FIGS. 7, 10, and 11. First pivot 64 includes a first pivot axle 106 and a first washer 108. First pivot axle 106 extends through an anchor ear opening 110 formed in each anchor ear 104, through first washer 108, and through a link opening 112 formed in link 68 for pivotable movement between anchor 62 and link 68 upon movement of leg 30 between the raised and fold-down positions.

Attachment 46 includes a pair of attachment ears 114 coupled to and extending from attachment body 49, as shown, for example, in FIGS. 7, 10, and 11. Second pivot 66 includes a second pivot axle 116 and a second washer 118. Second pivot axle 116 extends through an attachment ear opening 120 formed in each attachment ear 114, through second washer 118, and through an elongated slot 82 formed in link 68.

Figure 16:
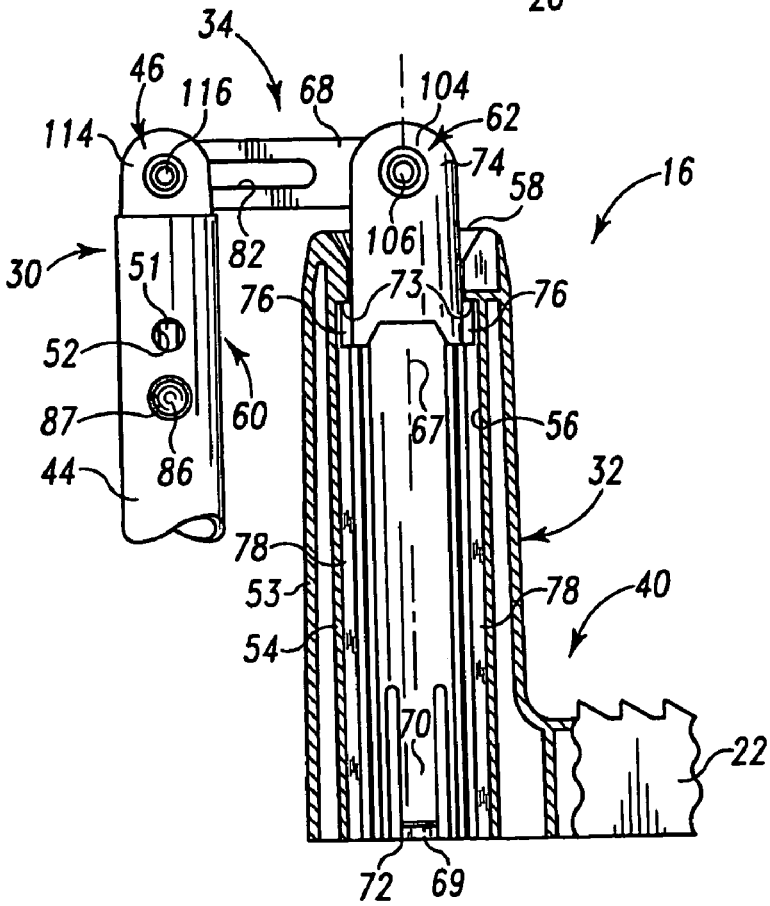
FIG. 16 is a sectional view taken along lines 16—16 of FIG. 15 showing engagement between the anchor and an anchor stop included in the leg receiver when the bed rail assumes the fold-down position.

Anchor 62 is used to anchor leg 30, movable jaw 24, and side rail 20 to foot 40 when bed rail 10 assumes the fold-down position. To do so, anchor 62 is positioned in channel 56 to slide in channel 56 longitudinally along an axis 67 of channel 56, as shown, for example, in FIG. 13. Thus, the lower end of elongated member or leg 30 slidably engages hollow sleeves 53 and 54 which form a hollow arm of the lower jaw 24. Anchor 62 is arranged slide in channel 56 between a lower, at-rest position shown, for example, in FIGS. 9–11 and an upper, anchoring position shown, for example, in FIG. 16. In the lower, at-rest position, anchor 62 is held in channel 56 by finger lugs 69 of a pair of flexible fingers 70 included in inner sleeve 54. Fingers 70 are flexible to allow insertion of anchor 62 into channel 56 through a lower end opening 72 during assembly of bed rail 10. In the upper, anchoring position, anchor 62 engages an anchor stop 73 included in inner sleeve 54. Such engagement between anchor 62 and anchor stop 73 maintains the connection between leg 30 and leg receiver 32 when leg 30 assumes the fold-down position.

Anchor 62 and channel 56 are arranged to facilitate movement of anchor 62 therein. Anchor 62 includes a pair of tabs 76 coupled to and extending outwardly from anchor body 74, as shown, for example, in FIGS. 7, 9, 13, 14, and 16. Tabs 76 fit in a pair of grooves 78 formed in channel 56 for movement in grooves between the lower, at-rest position and the upper, anchoring position, as shown, for example, in FIG. 14. Tabs 76 engage anchor stop 73 when anchor 62 assumes the upper, anchoring position. Channel 56 includes four circumferentially spaced-apart rails 80 that extend longitudinally along channel 56, as shown, for example, in FIG. 14. Rails 80 are arranged to engage body 74 as anchor 62 moves through channel 56. Grooves 78 and rails 80 cooperate to provide an anchor guide 81 for guiding movement of anchor 62 in channel 56.

Second pivot axle 116 is arranged to move in elongated slot 82 upon movement of leg 30 between the raised and fold-down positions, as suggested, for example, in FIGS. 10, 11, 12, 13, 15, and 16. Such movement of second pivot axle 116 in slot 82 allows for movement of leg 30 toward anchor 62 upon movement of leg 30 to the raised position to promote efficient use of space in channel 56. Such movement of second pivot axle 116 in slot 82 also allows for movement of leg 30 away from anchor 62 upon movement of leg 30 to the fold-down position so that leg 30 and side rail 20 can move from being right-side up in the raised position to being upside-down in the fold-down position.

Lock 36 is arranged to move between a locking position shown, for example, in FIG. 10 and an unlocking position shown, for example, in FIG. 11. In the locking position, lock 36 locks leg 30 in leg receiver 32 to thus lock leg 30 and side rail 20 in the raised position. In the unlocking position, lock 36 is positioned to allow removal of leg 30 from leg receiver 32 to allow movement of leg 30 and side rail to the fold-down position. Lock release 38 is arranged to move lock 36 from the locking position to the unlocking position, as shown, for example, in FIG. 11.

Lock 36 includes a spring 84 and a locking pin 86 coupled thereto, as shown, for example, in FIG. 7. Spring 84 is mounted in an interior region 88 formed in leg 30 and provided by outer tube 44 and attachment 46. Locking pin 86 is aligned with a leg opening 87 formed in leg 30 for movement therein upon movement between the locking and unlocking positions. In the locking position, pin 86 is arranged to extend into an inner sleeve opening 90 formed in inner sleeve 54 to lock leg 30 in leg receiver 32 and thus lock leg 30 and side rail 20 in the raised position, as shown, for example, in FIG. 10.

A button 92 included in lock release 38 is arranged to move inwardly through an outer sleeve opening 94 to retract pin 86 inwardly from inner sleeve opening 90 into interior region 88 to the unlocking position upon application of a release force 96 to button 92, as shown, for example, in FIG. 11. A spring 98 positioned between inner sleeve 54 and button 92 is used to move button 92 outwardly upon removal of release force 96 from button 92.

To use bed rail 10, fixed jaw 22 is positioned between mattress 14 and box spring unit 26 in a fixed position. Initially, bed rail 10 is in the raised position, as shown, for example, in FIGS. 3 and 8–10. In this position, lower leg end portion 60 is locked in channel 56 by lock 36 so that leg 30 and side rail 10 are rightside-up and side rail 20 is positioned higher than a top surface 100 of mattress 14. Side rail 20 is higher than top surface 100 to inhibit unintended movement of a person off mattress 14 once mattress is clamped. Lower leg end portion 60 remains locked in channel 56 upon clamping and unclamping of mattress 14. Button 92 is actuated to release locking pin 86 from inner sleeve opening 90 to unlock leg 30, as shown, for example, in FIG. 11.

Once unlocked, leg 30 and side rail 20 can transition from the raised position to the fold-down position, as shown, for example, in FIGS. 5 and 12–14. During such transitional movement, leg 30 is withdrawn from channel 56 thereby causing second pivot 66 to move through slot 82 and engage link 68. Engagement between second pivot 66 and link 68 causes anchor 62 to start moving upwardly through channel 56 from its lower, at-rest position toward its upper, anchoring position, as shown, for example, in FIG. 13. Anchor guide 81 guides movement of anchor 62 as anchor 62 moves through channel 56, as shown, for example, in FIG. 14.

Figure 6:
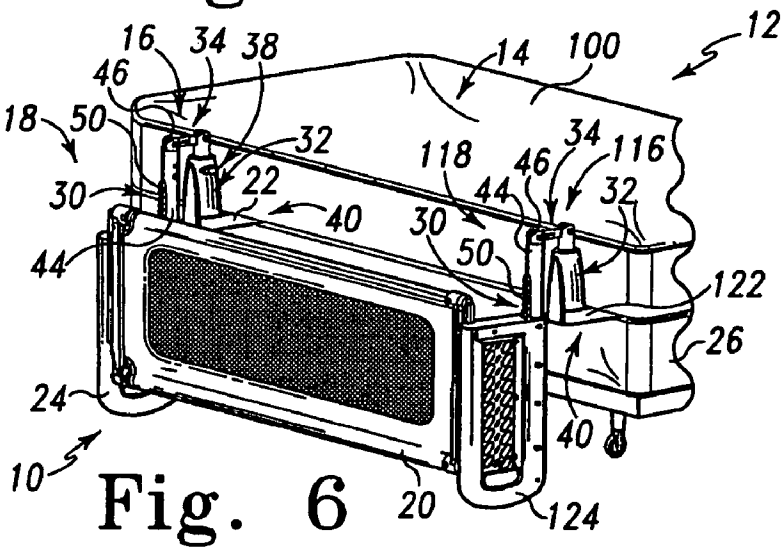
FIG. 6 is a perspective view showing the bed rail assuming the fold-down position.
Figure 15:
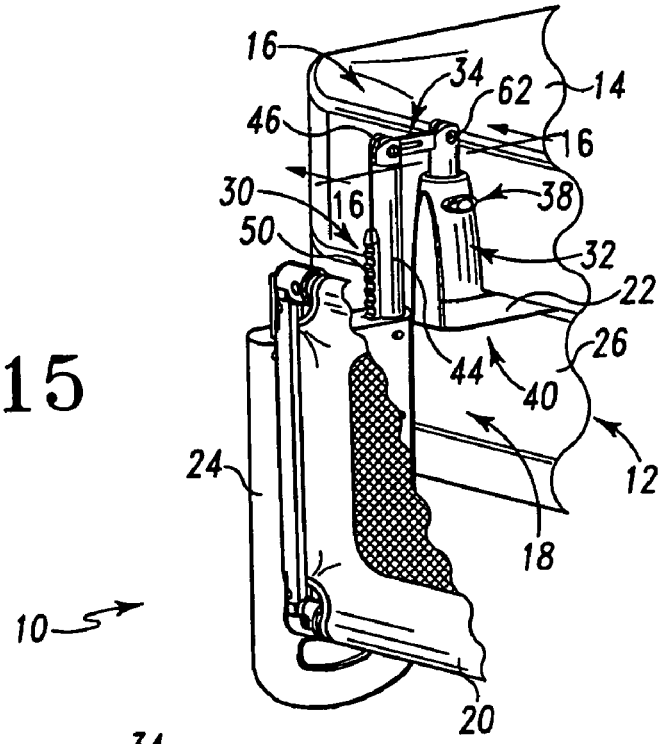
FIG. 15 is a perspective view, with portions broken away, showing the left clamp and the left end portion of the side rail in the fold-down position.

In the fold-down position, leg 30 and side rail 20 are upside-down and side rail 20 is lower than top surface 100 of mattress 14, as shown, for example, in FIGS. 6 and 15. Leg 30 and side rail 20 are oriented in this manner to minimize the amount of space occupied by bed rail 10 when bed rail 10 is not in use. Tabs 76 of anchor 62 engage anchor stop 73 to maintain the connection between leg 30 and leg receiver 32 when leg 30 and side rail 20 assume the fold-down position.

Figure 19:
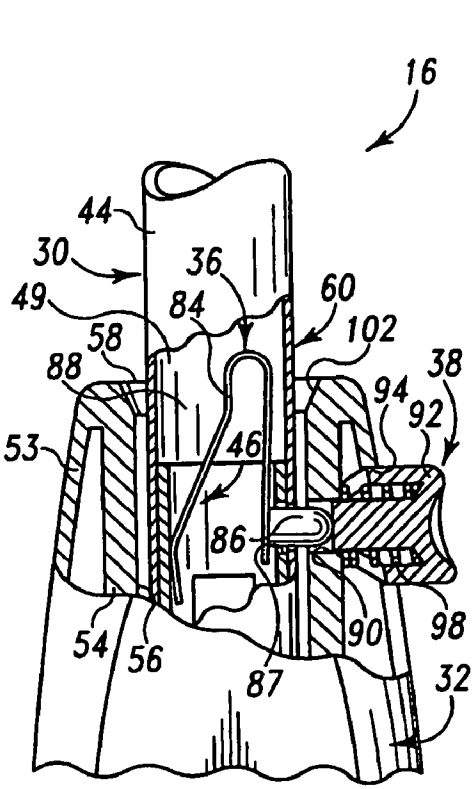
FIGS. 17–19 are sectional views that are similar to FIGS. 10 and 11 and show, in series, movement of the lock to its locked position upon insertion of the leg into the channel of the leg receiver during movement of the bed rail to the raised position.
Figure 18:
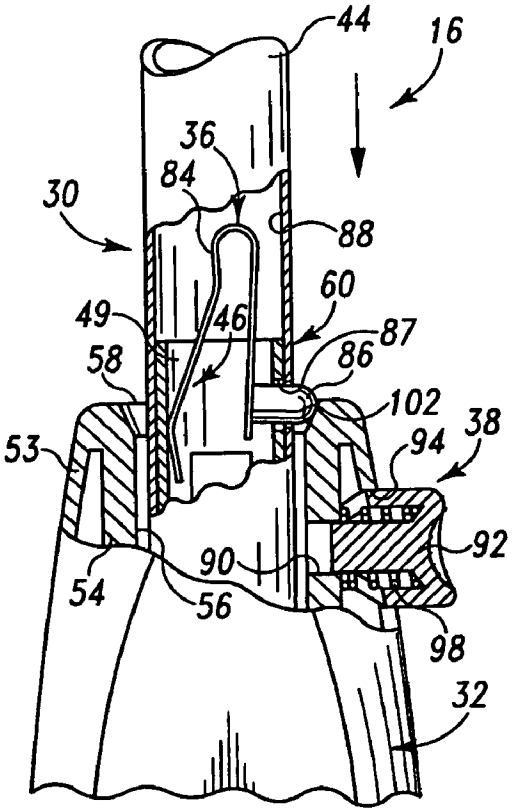
Figure 17:
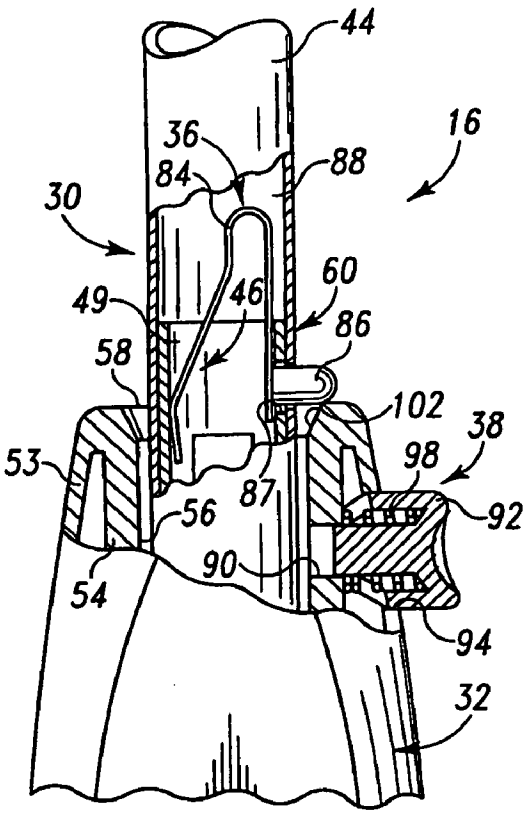

Leg 30 and side rail 20 can be moved back to the raised position by inserting lower leg end portion 60 back into channel 56. As such movement occurs, locking pin 86 engages an inclined surface 102 formed in inner sleeve 54 and is retracted into interior region 88 of leg 30 in response to such engagement, as shown, for example, in FIGS. 17 and 18. Locking pin 86 becomes aligned with and is moved into inner sleeve opening 90 by spring 84 to lock leg 30 in leg receiver 32 upon further insertion of lower leg end portion 60 into channel 56, as shown, for example, in FIG. 19. The leg 30 and side rail 20 thus re-assume the raised position upon reception of leg 30 in leg receiver 32.

Fold controller 16 provides means for controlling movement of side rail 20 relative to a base 22 between a raised position extending higher than base 22 so that side rail 20 extends higher than top surface 100 of mattress 14 when base 22 is positioned under mattress 14 in the fixed position and a fold-down position extending lower than base 22 so that side rail 20 extends lower than top surface 100 of mattress 14 when base 22 is positioned under mattress 14 in the fixed position. Fold controller 116 provides means for controlling movement of side rail 20 relative to a base 122 between a raised position extending higher than base 122 so that side rail 20 extends higher than top surface 100 of mattress 14 when base 122 is positioned under mattress 14 in the fixed position and a fold-down position extending lower than base 122 so that side rail 20 extends lower than top surface 100 of mattress 14 when base 122 is positioned under mattress 14 in the fixed position. It is within the scope of this disclosure for mattress 14 to be unclamped in such a raised position. It is also within the scope of this disclosure for mattress 14 to be clamped in such a raised position.

As shown in FIG. 20, right and left clamps 214, 314 included in bed rail 210 are configured to clamp a mattress 216 included in bed 212 to mount bed rail 210 to bed 212 and to mount a side rail 218 included in bed rail 210 alongside mattress 216, as discussed in more detail herein. When bed rail 210 is no longer needed, it may be removed from bed 212.

Right clamp 214 includes a right fixed jaw 220, a right movable jaw 222, and a right motion controller 224 and left clamp 314 includes a left fixed jaw 320, a left movable jaw 322, and a left motion controller 324, as shown, for example, diagrammatically in FIG. 21. Fixed jaws 220, 320 are configured to be positioned under mattress 216 in a fixed position between mattress 216 and an underlying box spring unit 226.

Movable jaws 222, 322 are configured to be positioned over mattress 216. Right movable jaw 222 has a surface which is configured or shaped to move toward right fixed jaw 220 to grip clamp mattress between right fixed jaw 220 and right movable jaw 222 and to move away from right fixed jaw 220 to unclamp or disengage mattress 216. Left movable jaw 322 is configured to move toward left fixed jaw 320 to clamp mattress 216 between left fixed jaw 320 and left movable jaw 322 and to move away from left fixed jaw 320 to unclamp mattress 216.

Right motion controller 224 is configured to control relative movement of jaws 220, 222. Right motion controller 224 thus provides motion controller means for controlling relative movement of jaws 220, 222 toward one another to clamp mattress 216 and away from one another to unclamp mattress 216.

Left motion controller 324 is configured to control relative movement of jaws 320, 322. Left motion controller 324 thus provides motion controller means for controlling relative movement of jaws 320, 322 toward one another to clamp mattress 216 and away from one another to unclamp mattress 216.

Right and left clamps 214, 314 are similar to one another in structure and function. Thus, the description herein of right clamp 214 and its components applies also to left clamp 314 and its components.

Fixed jaw 220 is configured to inhibit detachment of bed rail 210 from bed 212. Fixed jaw 220 includes a number ridges 228 formed in a top surface of fixed jaw 220 and an anti-slide member 230 formed to include a number of teeth, as shown, for example, in FIG. 20. Ridges 228 and the teeth of anti-slide member 230 are configured to engage a bottom surface of mattress 216 to inhibit withdrawal of fixed jaw 220 from between mattress 216 and box spring unit 226.

A jaw connector 232 interconnects support portions or fixed jaws 220 of left and right clamps 216, as shown, for example, in FIG. 20. In the illustrated embodiment, jaw connector 232 includes selectively telescoping tubes 234 configured to extend and to be locked in an extended, use position.

Figure 23:
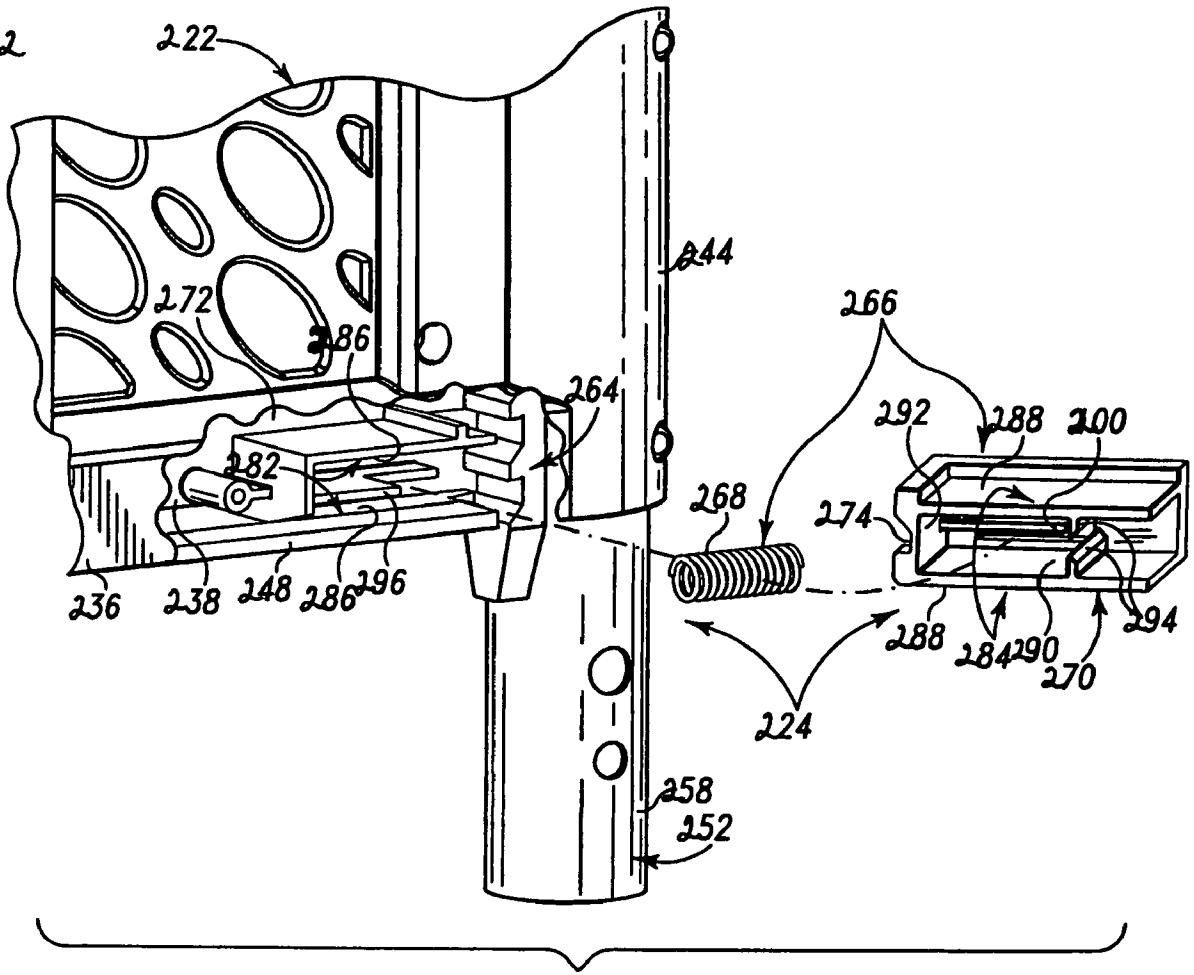
FIG. 23 is a partially exploded perspective view, with portions broken away, showing the right motion controller further including a ratchet coupled to the leg and a ratchet engagement device including a body configured to engage the ratchet and a mover (e.g., a spring) configured to move the body into engagement with the ratchet.
Figure 22:
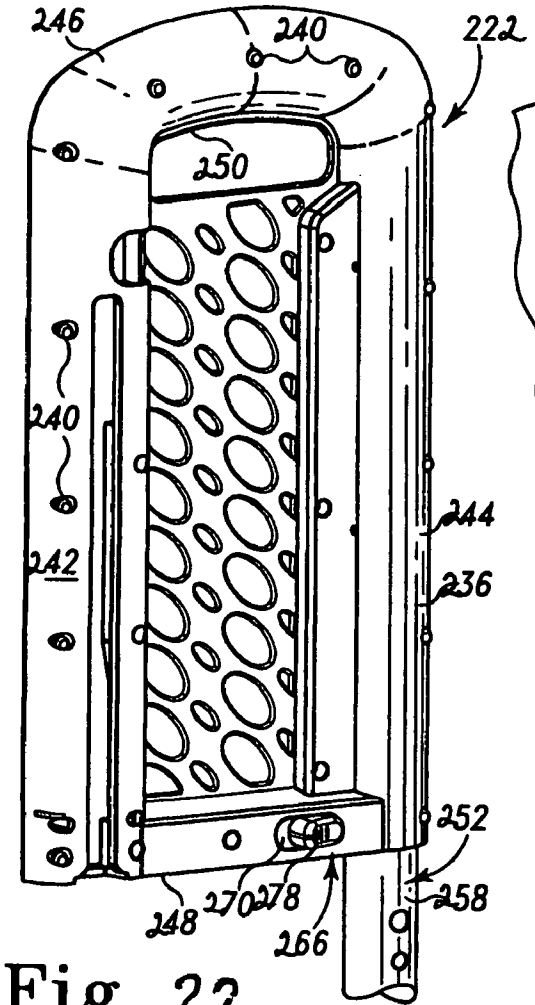
FIG. 22 is a perspective view of the right clamp, with portions broken away, showing the right movable jaw supported by a leg included in the right motion controller.
Figure 26:
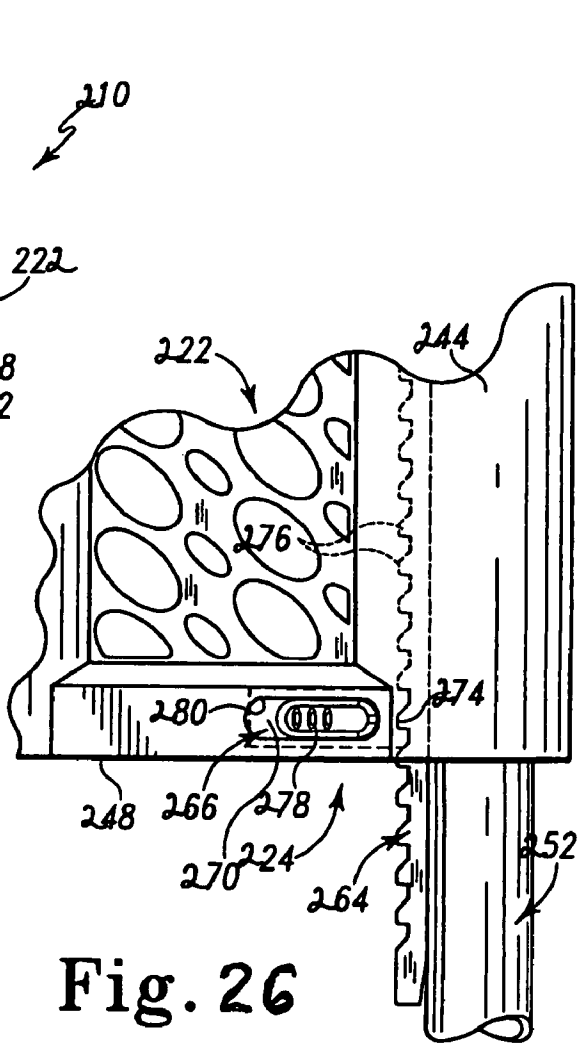
FIG. 26 is an elevation view of an inner side of the right clamp, with portions broken away, corresponding to the condition shown in FIGS. 5 and 6 and showing the body in its motion-limiting position.

Movable jaw 222 includes inner and outer shells 236, 238 coupled to one another by fasteners 240, as shown, for example, in FIGS. 22 and 23. Inner and outer shells 236, 238 cooperate to provide a forward portion 242 of movable jaw 222, a rearward portion 244 of movable jaw 222, a top portion 46 of movable jaw 222, and a bottom portion 248 of movable jaw 222. Side rail 218 is coupled to forward portion 242 for movement relative thereto. Rearward portion 244 is coupled to motion controller 224. Top portion 246 is formed to include a hand grip 250 configured to be gripped by a person's hand to push movable jaw 222 downwardly toward fixed jaw 220 for engagement between bottom portion 248 and mattress 216.

Figure 25:
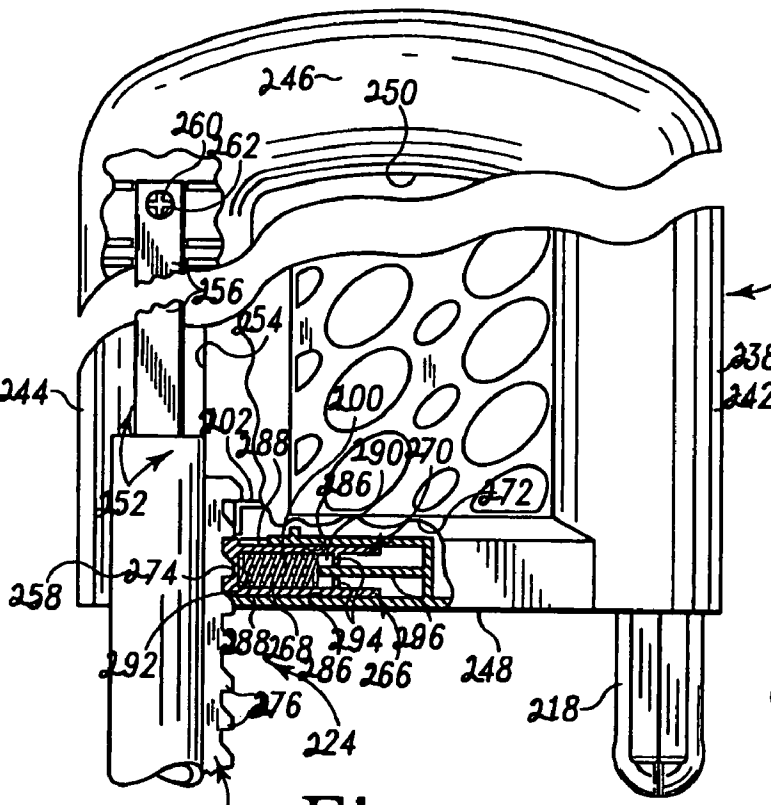
FIG. 25 is an enlarged end elevation view of the bed rail, with portions broken away, corresponding to the condition shown in FIG. 5 and showing the body of the right motion controller positioned in a motion-limiting position in which the body engages the ratchet of the right motion controller to block upward movement of the right movable jaw away from the right fixed jaw and, in the absence of application of an elevation adjustment force to the right movable jaw, to block downward movement of the right movable jaw toward the fixed jaw to position the right movable jaw and the side rail coupled thereto at a selected elevation.
Figure 29:
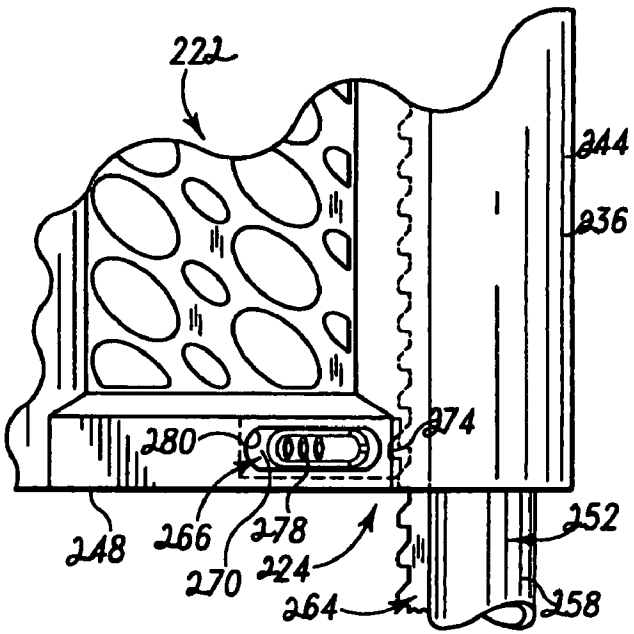
FIG. 29 is an elevation view of the inner side of the right clamp, with portions broken away, corresponding to the condition shown in FIGS. 8 and 9 and showing movement of the body of the right motion controller due to camming engagement between the body and the ratchet during downward movement of the right movable jaw.
Figure 27:
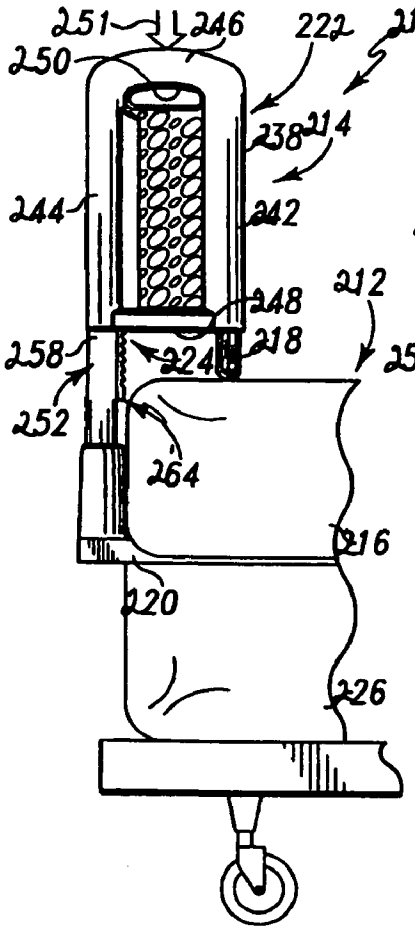
FIG. 27 is an end elevation view of the bed rail showing downward movement of the right movable jaw toward the right fixed jaw and the mattress upon application of the elevation adjustment force to the right movable jaw.
Figure 32:
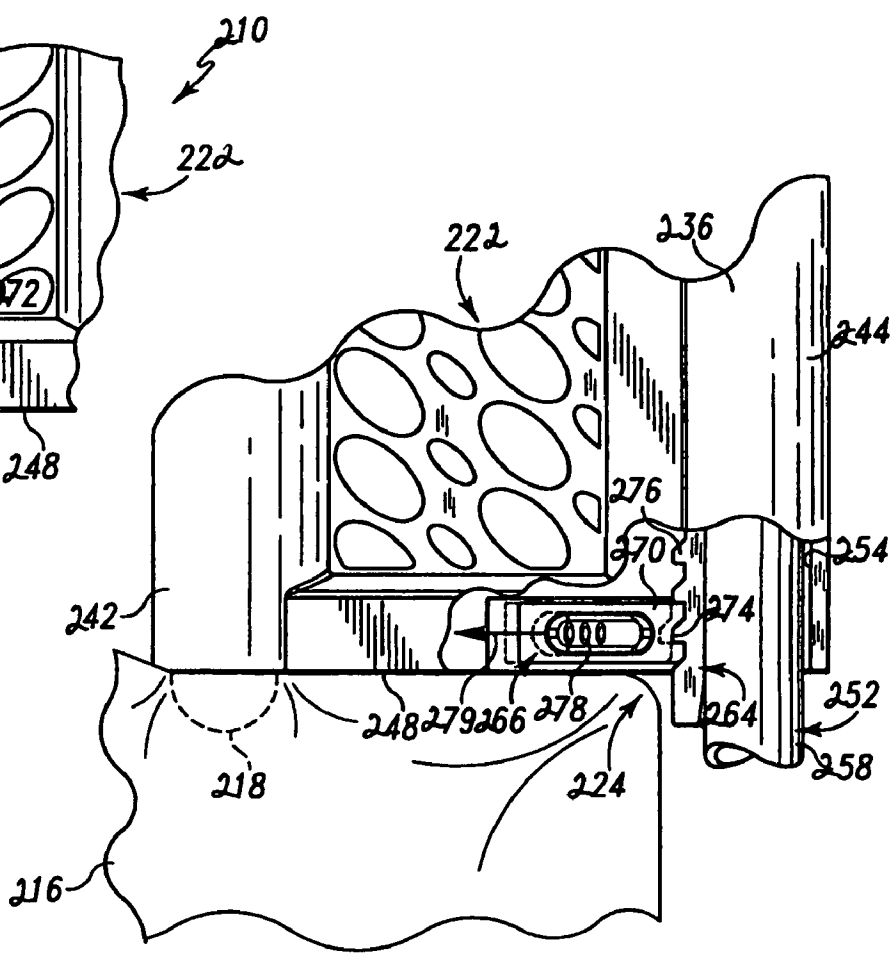
FIG. 32 is an elevation view of the inner side of the right clamp, with portions broken away, corresponding to the condition shown in FIGS. 11 and 12 and showing, in solid lines, the body assuming its motion-limiting position so that the mattress remains clamped and, in phantom, the body assuming a motion-enabling position upon application of a release force to a release coupled to the body to allow upward movement of the right movable jaw away from the right fixed jaw to unclamp the mattress.

Motion controller 224 is configured to move between a motion-limiting position shown, for example, in FIG. 25 and a motion-enabling position shown, for example, in phantom lines in FIG. 32. In the motion-limiting position, motion controller 224 blocks movement of movable jaw 222 away from fixed jaw 220 and, in the absence of application of an elevation adjustment force 251 to movable jaw 222, also blocks movement of movable jaw 222 toward fixed jaw 222 to position movable jaw 222 and side rail 218 coupled thereto at a selected elevation. Motion controller 224 allows movement of movable jaw 222 toward fixed jaw 220 to clamp mattress 216 upon application of elevation adjustment force 251 to movable jaw when motion controller 224 is positioned in the motion-limiting position, as suggested in FIGS. 27–29. In the motion-enabling position, motion controller 224 allows movement of movable jaw 222 toward fixed jaw 220 and allows movement of movable jaw 222 away from fixed jaw 220 to unclamp mattress 216.

Motion controller 224 includes a leg 252 shown, for example, in FIGS. 20 and 25 and a guide channel 254 shown, for example, in FIG. 25. Leg 252 extends from fixed jaw 220 into guide channel 254. Guide channel 254 is formed in inner and outer shells 236, 238 of movable jaw 222 and configured to guide movement of movable jaw 222 along leg 252.

Figure 28:
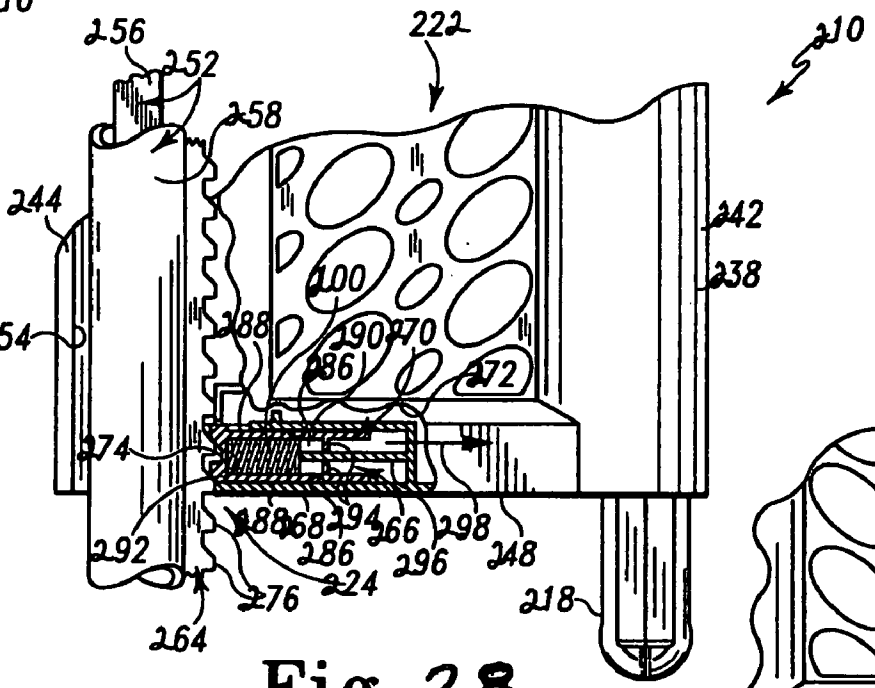
FIG. 28 is an enlarged end elevation view of the bed rail, with portions broken away, corresponding to the condition shown in FIG. 8 and showing camming engagement between the body and the ratchet to allow downward movement of the right movable jaw upon application of the elevation adjustment force to the right movable jaw.
Figure 31:
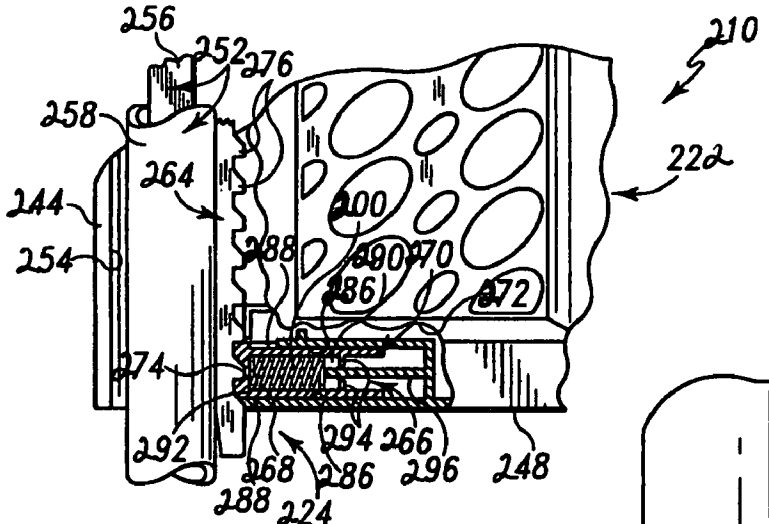
FIG. 31 is an enlarged end elevation view of the bed rail, with portions broken away, corresponding to the condition shown in FIG. 11.

In the illustrated embodiment, leg 252 includes telescoping inner and outer tubes 256, 258, as shown, for example, in FIGS. 25, 28, and 31. Inner tube 256 is coupled to movable jaw 222 by a tube mount 260 which extends into an aperture 262 formed in an upper end portion of inner tube 256, as shown, for example, in FIG. 25.

Motion controller 224 includes a ratchet 264 having a plurality of step openings or holes at intervals along one surface and a ratchet engagement device 266, as shown, for example, in FIGS. 23, 25, 26, 28, 29, 31, and 32. Ratchet 264 is coupled to outer tube 258. Ratchet engagement device 266 is coupled to movable jaw 222 for movement relative to ratchet 264 between the motion-limiting position in which device 266 engages the openings or holes in ratchet 264 and the motion-enabling position in which device 266 is removed from the openings or holes and releases ratchet 264. Device 266 thus provides means for engaging ratchet 264 to clamp mattress 216 and for releasing ratchet 264 to unclamp mattress 216. Thus, a releasable locking means is provided for locking the ratchet with respect to the movable jaw and a lock for locking the leg with respect to the fixed law.

Device 66 includes a slidable body 270, a mover 268, and a release 278, as shown, for example, in FIGS. 22 and 23. Body 270 is positioned in a jaw interior region 272 formed in movable jaw 222 and is formed to include a notch member 274 configured to receive teeth 276 included in ratchet 264. As seen in for example. FIG. 25, the notch member 274 comprises portions which enter the openings or holes in ratchet 264. Mover 268 moves or biases body 270 toward ratchet 264 to the motion-limiting position and is configured, for example, as a spring (FIG. 23).

Release 278 is coupled to body 270 to move body to the motion-enabling position upon application of a release force 279 to release 278 by a user. Release 278 is configured, for example, as a lug extending from body 270 through an exterior access opening 280 formed in inner shell 236 for external access to release 278 by the user. Body 270 and release 278 cooperate to provide a button.

Body 270 is configured to slide between the motion-limiting and motion-enabling positions. Movable jaw 222 includes a guide 282 and body 270 includes a guide follower 284 configured to follow 282, as shown, for example, in FIG. 23. Guide 282 includes upper and lower guide surfaces 286. Follower 284 includes upper and lower follower surfaces 288 configured to slide against upper and lower guide surfaces 286 for linear movement of body 270.

Spring 268 is positioned in a body interior region 290 shown, for example, in FIG. 23. Spring 268 is captured between a spring retention surface 292 positioned to one side of spring 268 and a pair of spring retention tabs 294 positioned to an opposite side of spring 268. Spring retention tabs 294 are mounted in spaced-apart relation to one another to receive a spring compression tab 296 therebetween.

Spring compression tab 296 is included in movable jaw 222 and configured to extend between spring retention tabs 294 to engage spring 268 for compression thereof upon movement of body 270 in a direction 298, as shown, for example, in FIG. 28. Such movement may occur due to camming engagement between notch member 274 and teeth 276 and may occur due to application of release force 279 to release 278 to move body 270 to the motion-enabling position.

A spring alignment tab 300 shown, for example, in FIG. 23 is configured to align spring 268 with spring compression tab 296 for engagement therewith. Spring alignment tab 300 is coupled to body 270 to extend in body interior region 290 and extends longitudinally along spring 268 for engagement with spring 268.

To use bed rail 210, bed rail 210 is first coupled to bed 212. To couple bed rail 210 to bed 212, right and left clamps 214, 314 are clamped to mattress 216. Side rail 218 is mounted alongside bed 212 upon clamping of clamps 214, 314 to bed 212. Each clamp 214, 314 thus provides means for clamping mattress 216 to position side rail 218 alongside mattress 216.

Figure 24:
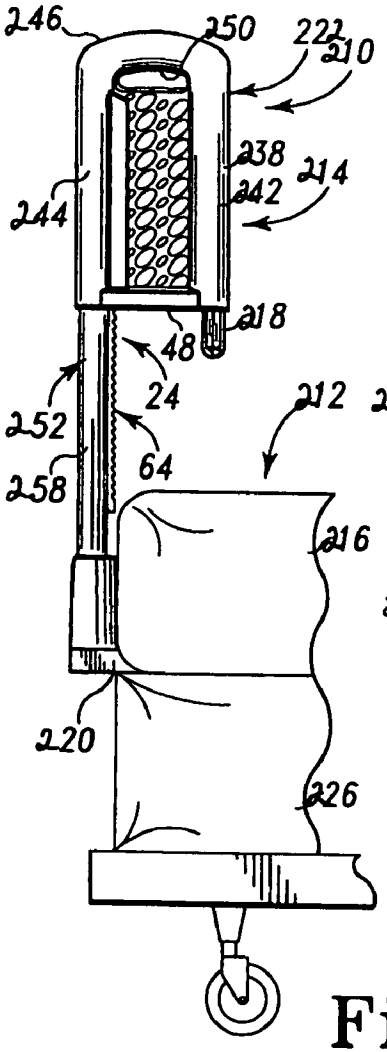
FIG. 24 is an end elevation view of the bed rail showing the right fixed jaw extending between the mattress and an underlying box spring unit and showing the right movable jaw elevated above the mattress and ready for downward movement to clamp the mattress between the right fixed jaw and the right movable jaw.

Before clamping of mattress 216, fixed jaws 220, 120 are inserted between mattress 216 and box spring unit 226 and side rail 218 and movable jaws 222, 122 are positioned at an elevated position over mattress 216 in a mattress-unclamping position, as shown, for example, in FIG. 24. Each body 270 is positioned in its motion-limiting position, as shown, for example, in FIGS. 25 and 26, to maintain side rail 218 and movable jaws 222, 122 in the elevated position.

Figure 13:
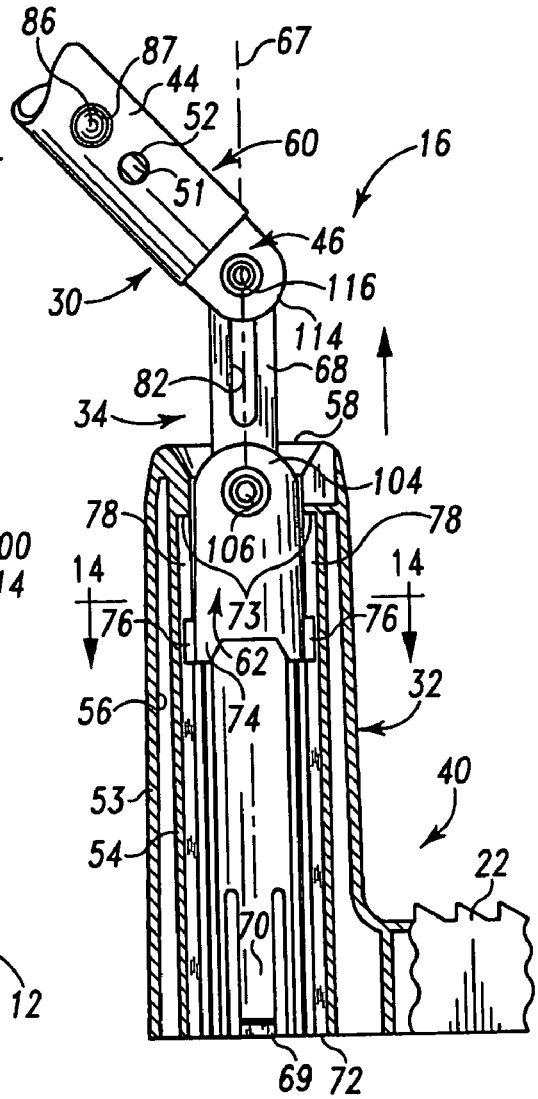
FIG. 13 is a sectional view taken along lines 13—13 of FIG. 12 showing slidable movement of the anchor in a channel formed in the leg receiver upon movement of the bed rail to the fold-down position.
Figure 14:
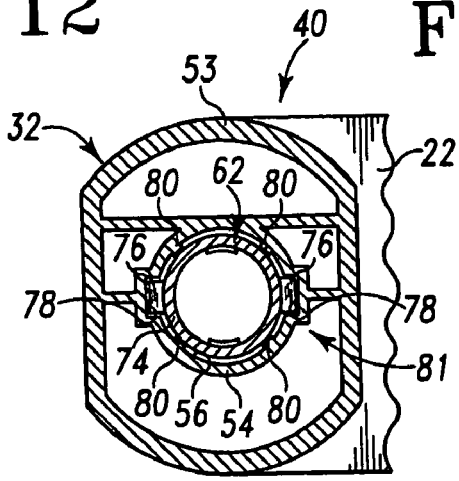
FIG. 14 is a sectional view taken along lines 14—14 of FIG. 13 showing tabs of the anchor extending into grooves of the channel and rails of the channel spaced circumferentially about a body of the anchor for slidable engagement therewith.
Figure 30:
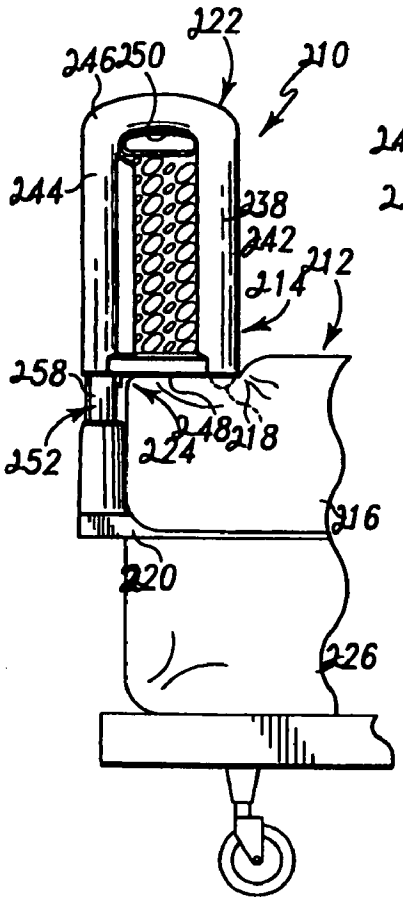
FIG. 30 is an end elevation view of the bed rail showing the right movable jaw and the right fixed jaw clamping the mattress therebetween.

Clamps 214, 314 are then clamped to mattress 216. Elevation adjustment force 251 is applied to each hand grip 251 to lower side rail 218 and movable jaws 222, 122 into contact with mattress 216 to apply a clamping force thereto, as shown, for example, in FIG. 27. Bodies 270 cam against teeth 276 of ratchets 264 to allow lowering of side rail 218 and movable jaws 222, 122, a shown in FIGS. 28 and 29. Further downward movement of side rail 218 and movable jaws 222, 122 causes movable jaws 222, 122 to assume a mattress-clamping position so that mattress 216 becomes clamped between movable jaws 222, 122 and fixed jaws 220, 120, as shown in FIG. 30. When mattress 216 is clamped, bodies 270 are in their motion-limiting position to block upward movement of movable jaws 222, 122 to lock movable jaws 222, 122 in their mattress-clamping position, as shown in FIGS. 12 and 13.

To unclamp mattress 216, release force 279 is applied to releases 278, as shown, for example, in FIG. 32. Release force 279 moves bodies 270 from the motion-limiting position to the motion-enabling position to allow elevation of side rail 218 and movable jaws 222, 122 away from mattress 216 back to a mattress-unclamping position shown, for example, in FIG. 24. An elevation limiter 302 shown, for example, in FIG. 25, is coupled to each outer shell 238 to engage a ratchet 264 to limit elevation of side rail 218 and movable jaws 222, 122.

Figure 33:
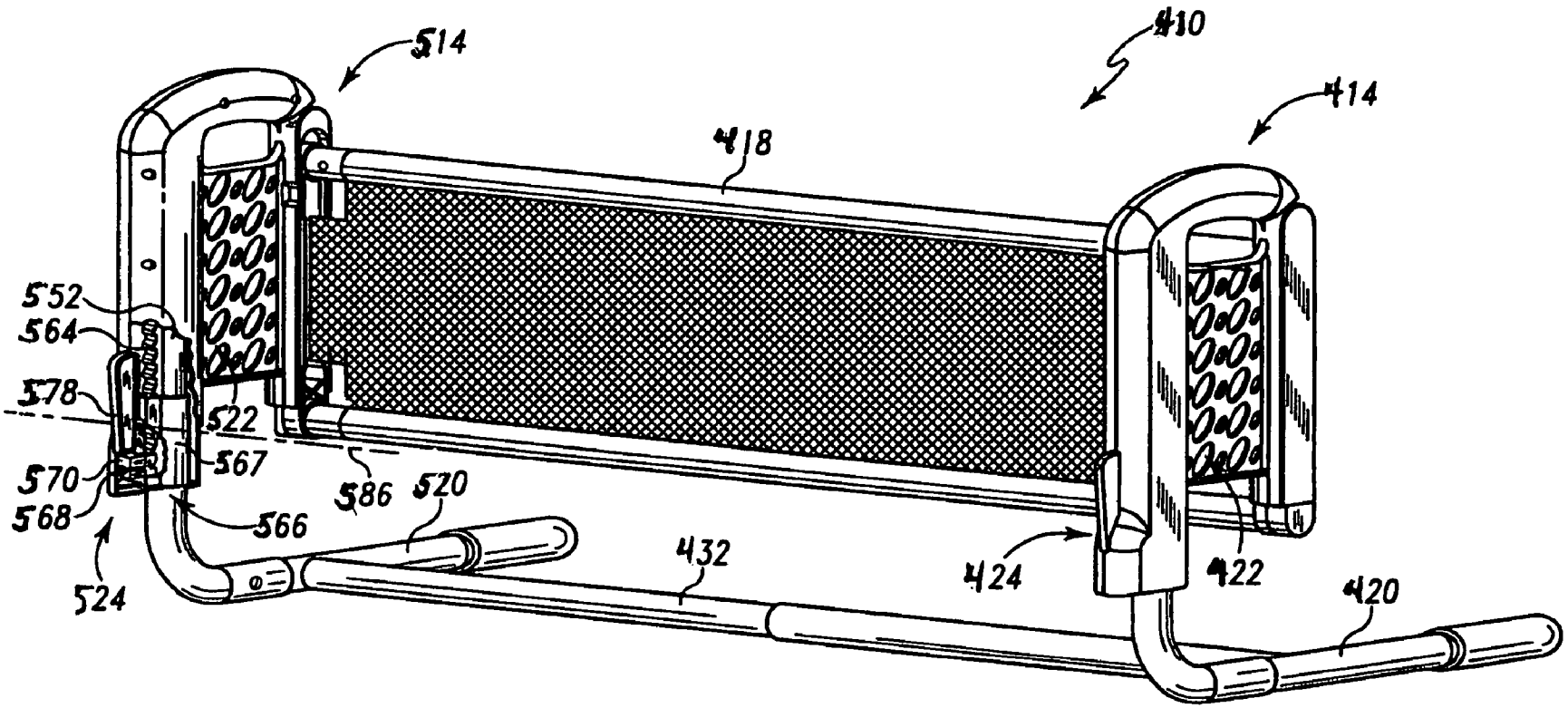
FIG. 33 is a perspective view of another bed rail which includes left and right clamps coupled to a side rail extending therebetween.

A bed rail 410 shown, for example, in FIG. 33 is configured for use with bed 212. Bed rail 410 includes right and left clamps 414, 514 configured to clamp mattress 216 to mount a side rail 418 alongside mattress 216 and to unclamp mattress 216. Each clamp 224, 514 thus provides means for clamping mattress 216 to position side rail 218 alongside mattress 216.

Right clamp 414 includes a right fixed jaw 420, a right movable jaw 422, and a right motion controller 424. Similarly, left clamp 514 includes a left fixed jaw 520, a left movable jaw 522, and a left motion controller 524. Fixed jaws 420, 520 are connected by a jaw connector 432 and are configured to be positioned under mattress 216 in a fixed position between mattress 216 and underlying box spring unit 226.

Movable jaws 422, 522 are coupled to side rail 418 and configured to be positioned over mattress. Movable jaws 422, 522 are configured to move toward fixed jaws 420, 520 to move side rail 418 toward mattress 216 to clamp mattress 216 between side rail 418 and fixed jaws 420, 520 to mount side rail 418 alongside mattress 216. Movable jaws 422, 522 are configured to move away from fixed jaws 420, 520 to move side rail 418 away from mattress 216 to unclamp mattress 216.

Right motion controller 424 is configured to control relative movement between right fixed jaw 420 and right movable jaw 422. Right motion controller 424 thus provides motion controller means for controlling relative movement between jaws 420, 422 toward one another to clamp mattress 216 and away from one another to unclamp mattress 216.

Left motion controller 524 is configured to control relative movement between left fixed jaw 520 and left movable jaw 522. Left motion controller 524 thus provides motion controller means for controlling relative movement between jaws 520, 522 toward one another to clamp mattress 216 and away from one another to unclamp mattress 216.

Clamps 414, 514 are similar to one another in structure and function. Thus, the description herein of left clamp 514 applies also to right clamp 414.

Figure 34:
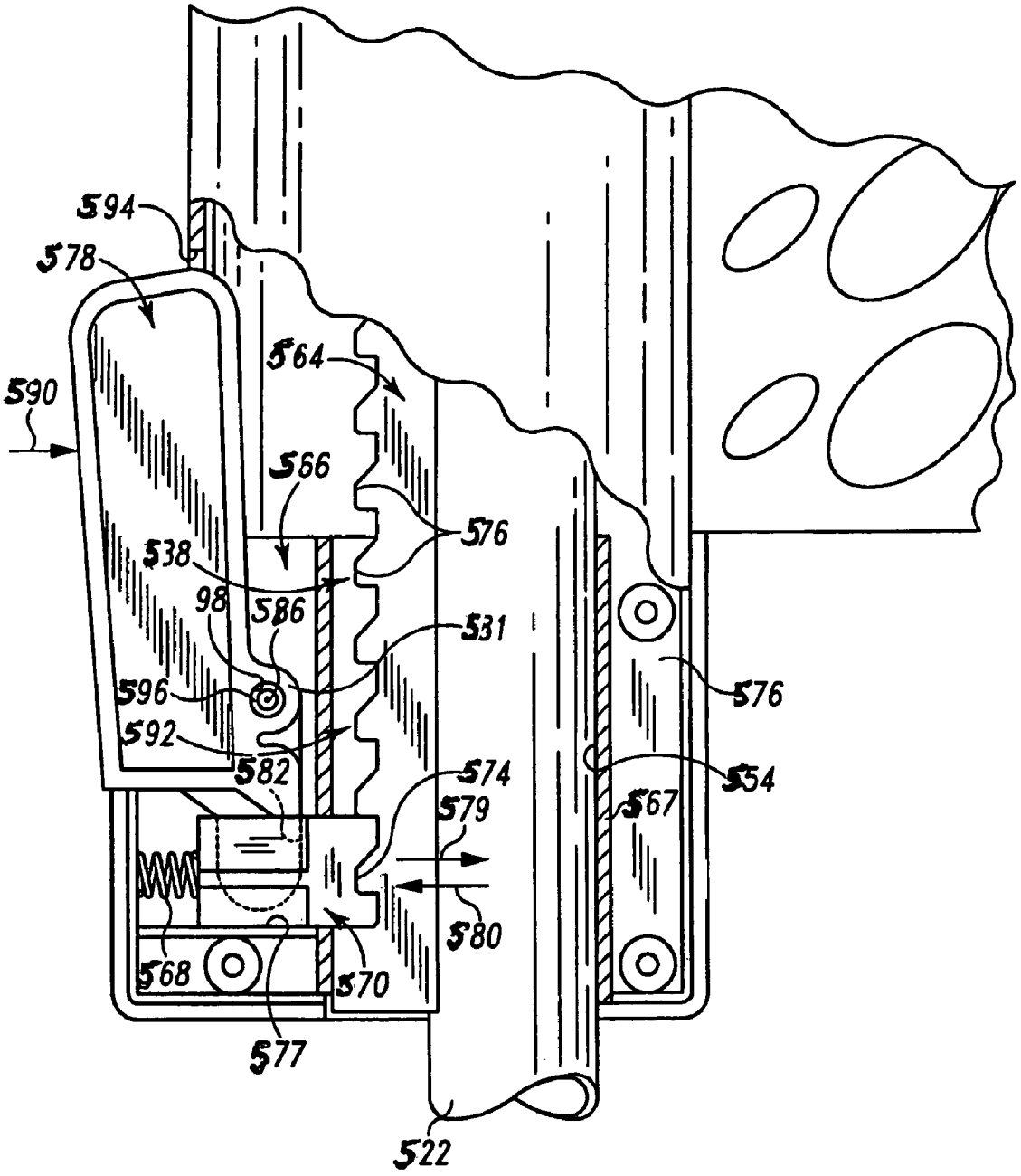
FIG. 34 is an elevation view, with portions broken away, showing components of the left clamp.

Motion controller 524 includes a leg 552, a ratchet 364, and a ratchet engagement device 566, as shown, for example, in FIG. 34. Leg 552 is coupled to and extends upwardly from fixed jaw 520 into an interior region 572 formed in movable jaw 522. Ratchet 564 is coupled to leg 552. A sleeve 567 is positioned in interior region 572 to receive and surround leg 552 and ratchet 564 coupled thereto. Sleeve 567 is formed to include a guide channel 554 to guide movement of movable jaw 522 along leg 552.

Ratchet engagement device 566 is coupled to movable jaw 522 for movement therewith as movable jaw 522 moves toward and away from fixed jaw 520. Ratchet engagement device 566 includes a slidable body 570, a mover 568, and a release 578.

Mover 568 causes body 570 to slide along a surface 577 toward ratchet 564 in a ratchet-engagement direction 579 to a motion-limiting position so that body 570 normally engages ratchet 564. Engagement between body 570 and ratchet 564 allows movement of movable jaw 522 toward fixed jaw 520 to clamp mattress 216 but blocks movement of movable jaw 522 away from fixed jaw 520. Body 570 is formed to include a notch member 574 to engage teeth 576 included in ratchet 564. Mover 568 is configured, for example, as a spring.

Release 578 is configured to cause body 570 to slide along surface 577 away from ratchet 564 in a ratchet-release direction 580 to a motion-enabling position so that body 570 releases ratchet 564. Movable jaw 522 is allowed to move away from fixed jaw 520 to unclamp mattress 216 upon release of ratchet 564.

Release 578 includes a pivot 581, a body engagement tab 582, and an actuator tab 584. Pivot 581 is formed to include an axle-receiving opening 598 receiving an axle 596 for pivotable movement of release 578 about an axis 586. Body engagement tab 582 engages body 570 to move body 570 in ratchet-release direction 580 upon movement of actuator tab 584 through an external access opening 594 formed in movable jaw 522 in a first pivot direction 588 about axis 586 due to application of a release force 590 to actuator tab 584. Release force 590 may be applied to actuator tab 584 when the hand of a user grips a lower portion of movable jaw 520 so that the palm of the user's hand presses actuator tab 584 in first pivot direction 588. Release 578 will pivot about axis 586 through opening 594 in a second pivot direction 592 due to operation of mover 568 and engagement between body engagement tab 582 and body 570 when the user's hand is removed from actuator 584. Release 578 is configured, for example, as a plate.

Ratchet engagement device 566 provides means for engaging ratchet 564 to clamp mattress 216 and for releasing ratchet 564 to unclamp mattress 216.

Siderail 20 includes a rectangular rim and a fabric panel coupled to the rim as shown in FIGS. 1–6 and 20.

The invention claimed is:

1. A bed rail comprising: a support portion joined to a rail portion; the support portion being adjustable to grip a member such as a mattress member; locking means for releaseably locking the support portion at a desired gripping position.

2. The bed rail of claim 1 wherein said rail portion is pivotally coupled to said support portion and is moveable between an upright position and a released position wherein the rail portion is pivoted toward a sidewall of the mattress member.

3. The bed rail of claim 2 further comprising second releasable locking means for locking the rail portion to said support portion at at least the upright position.

4. The bed rail of claim 1 wherein said rail portion has a substantially rectangular-shaped frame; and a net-like member joined to said frame and spanning a hollow region surrounded by said frame.

5. The bed rail of claim 4 wherein said net-like member is netting.

6. The bed rail of claim 1 wherein said support portion is comprised of upper and lower jaws; one arm of each of the upper jaws being joined to said rail portion; elongated members, each having one end joined to an arm of each of said upper jaws and having a lower end slideably engaging one hollow arm of an associated one of the lower jaws; said releasable locking means locking each elongated member to one of the lower jaws; and a pair of base members, each coupled to one of the lower jaws.

7. The bed rail of claim 6 wherein said elongated member has a plurality of openings arranged at spaced intervals along one surface thereof; wherein said releasable locking means is normally biased in a direction toward said openings and enters one of said openings when aligned therewith; and wherein said releasable locking means is moveable to a releasing position displaced from said openings to enable sliding movement of the elongated member relative to the lower jaw.

8. The bed rail of claim 6 wherein each of said elongated members is slidably inserted into a hollow interior of an associated one of said arms of said lower jaw.

9. The bedrail of claim 6 wherein each of said elongated members and associated said lower jaws is slidably received by the other of said elongated members and an associated arm of said lower jaws.

10. The bed rail of claim 6 wherein each base member has a surface for engaging in underside of a mattress, said surface having at least one portion thereof which is provided with a surface configuration that promotes gripping between the mattress and the base member.

11. The bed rail of claim 6 wherein each of said upper jaws has a surface for engaging a mattress, said surface having at least one portion thereof that is provided with a surface configuration that promotes gripping between the mattress and the base member.

12. The bed rail of claim 1 wherein said bed rail is selectively extendible.

13. A bed rail comprising: a support portion joined to a rail portion; the support portion being adjustable to grip a member such as a mattress member; and a lock coupled to and releaseably locking the support portion at a desired gripping position.

14. The bed rail of claim 13 wherein the lock includes a push button for unlocking the lock.

* * * * *

US007028354C1

(12) EX PARTE REEXAMINATION CERTIFICATE (6127th)

United States Patent

Nygren et al.

(10) Number: US 7,028,354 C1

(45) Certificate Issued: *Feb. 19, 2008

(54) BED RAIL AND CLAMP

(75) Inventors: Kurt Nygren, Harvard, MA (US); Jorge Tomas, Wrentham, MA (US); Robert D. Monahan, Norwell, MA (US); Steve Lepke, Wakefield, MA (US)

(73) Assignee: Cosco Management, Inc., Wilmington, DE (US)

Reexamination Request:
No. 90/008,148, Aug. 4, 2006

Reexamination Certificate for:

| | |
|---|---|
| Patent No.: | **7,028,354** |
| Issued: | **Apr. 18, 2006** |
| Appl. No.: | **11/003,641** |
| Filed: | **Dec. 3, 2004** |

( * ) Notice: This patent is subject to a terminal disclaimer.

Related U.S. Application Data

(63) Continuation of application No. 10/735,356, filed on Dec. 12, 2003, now Pat. No. 7,024,708, and a continuation of application No. 10/734,346, filed on Dec. 12, 2003, now Pat. No. 6,886,196.

(60) Provisional application No. 60/433,113, filed on Dec. 13, 2002.

(51) Int. Cl.
*A47C 21/08* (2006.01)

(52) U.S. Cl. ..... 5/430; 5/426; 24/72.5

(58) Field of Classification Search ..... None
See application file for complete search history.

(56) References Cited

U.S. PATENT DOCUMENTS

| | | | |
|---|---|---|---|
| 1,760,346 | A | 5/1930 | Correa |
| 2,646,576 | A | 7/1953 | Abrams |
| 3,261,034 | A | 7/1966 | Bradley |
| 4,528,998 | A | 7/1985 | Gamm |
| 4,833,743 | A | 5/1989 | Howell et al. |
| 5,640,726 | A | 6/1997 | Fichner-Rathus |
| 6,550,082 | B2 | 4/2003 | Tharalson et al. |

*Primary Examiner*—Jeffrey R. Jastrzab

(57) ABSTRACT

A bed rail is disclosed for use with a bed. The bed rail includes a support portion joined to a rail portion. The support portion being adjustable to grip a member such as a mattress member. A fold controller controls foldable movement of the bed rail and adjustment to clamp the bedrail to the bed.

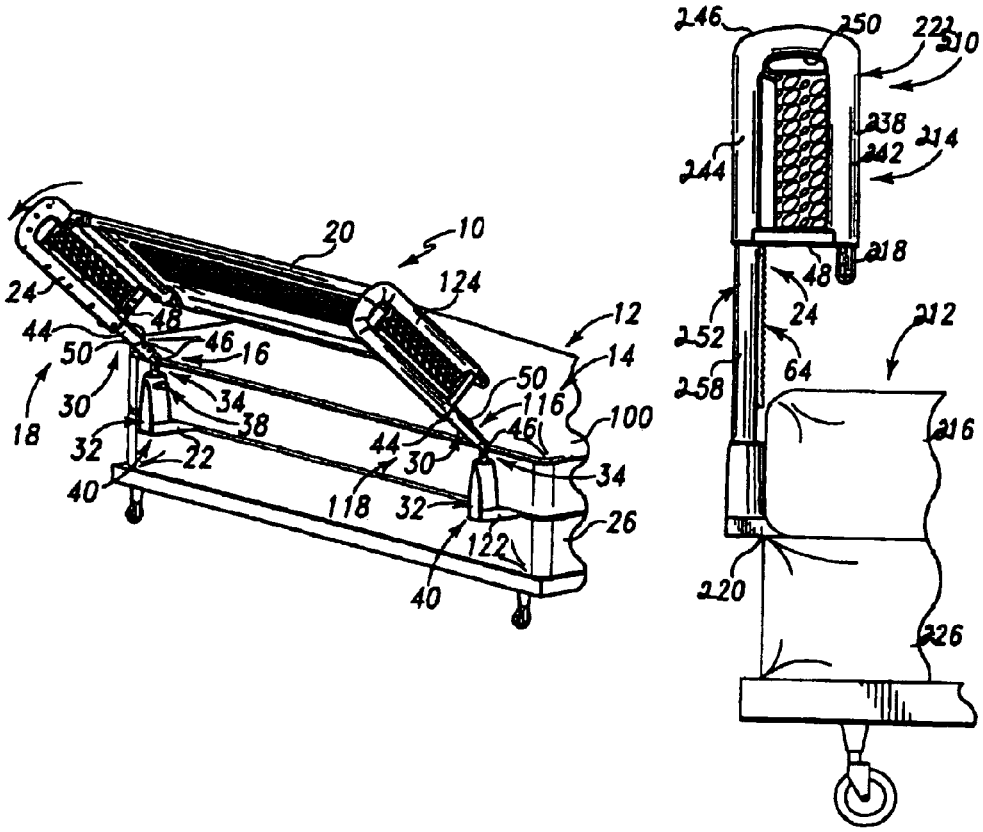

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 10 and 13 are determined to be patentable as amended.

Claims 2–9, 11, 12 and 14, dependent on an amended claim, are determined to be patentable.

New claims 15–25 are added and determined to be patentable.

1. A bed rail comprising: a support portion joined to a rail portion; *the rail portion extending substantially the length of a side of a mattress;* the support portion being adjustable to grip a member such as a mattress member; locking means for releaseably locking the support portion at a desired gripping position.

10. The bed rail of claim 6 wherein each base member has a surface for engaging [in] *an* underside of a mattress, said surface having at least one portion thereof which is provided with a surface configuration that promotes gripping between the mattress and the base member.

13. A bed rail comprising: a support portion joined to a rail portion; *the rail portion extending substantially the length of a side of a mattress;* the support portion being adjustable to grip a member such as a mattress member; and a lock coupled to and releaseably locking the support portion at a desired gripping position.

*15. The bed rail of claim 13 wherein said rail portion is pivotally coupled to said support portion and is moveable between an upright position and a released position wherein the rail portion is pivoted toward a sidewall of the mattress member.*

*16. The bed rail of claim 15 further comprising a second releasable lock for locking the rail portion to said support portion at at least the upright position.*

*17. The bed rail of claim 13 wherein said rail portion has a substantially rectangular-shaped frame; and a net-like member joined to said frame and spanning a hollow region surrounded by said frame.*

*18. The bed rail of claim 17 wherein said net-like member is netting.*

*19. The bed rail of claim 13 wherein said support portion is comprised of upper and lower jaws; one arm of each of the upper jaws being joined to said rail portion; elongated members, each having one end joined to an arm of each of said upper jaws and having a lower end slideably engaging one hollow arm of an associated one of the lower jaws; the lock locking each elongated member to one of the lower jaws; and a pair of base members, each coupled to one of the lower jaws.*

*20. The bed rail of claim 19 wherein said elongated member has a plurality of openings arranged at spaced intervals along one surface threof; wherein the lock is normally biased in a direction toward said openings and enters one of said openings when aligned therewith; and wherein the lock is moveable to a releasing position displaced from said openings to enable sliding movement of the elongated member relative to the lower jaw.*

*21. The bed rail of claim 19 wherein each of said elongated members is slidably inserted into a hollow interior of an associated one of said arms of said lower jaw.*

*22. The bedrail of claim 19 wherein each of said elongated members and associated said lower jaws is slidably received by the other of said elongated members and an associated arm of said lower jaws.*

*23. The bed rail of claim 19 wherein each base member has a surface for engaging an underside of a mattress, said surface having at least one portion thereof which is provided with a surface configuration that promotes gripping between the mattress and the base member.*

*24. The bed rail of claim 19 wherein each of said upper jaws has a surface for engaging a mattress, said surface having at least one portion thereof that is provided with a surface configuration that promotes gripping between the mattress and the base member.*

*25. The bed rail of claim 13 wherein said bed rail is selectively extendible.*

* * * * *